US009016842B2

(12) United States Patent
Miyashita et al.

(10) Patent No.: US 9,016,842 B2
(45) Date of Patent: Apr. 28, 2015

(54) LIQUID CONTAINER AND APPARATUS IN WHICH LIQUID CONTAINER IS MOUNTABLE

(71) Applicant: Canon Kabushiki Kaisha, Tokyo (JP)

(72) Inventors: Takeho Miyashita, Machida (JP); Yasuo Kotaki, Yokohama (JP); Koichi Kubo, Yokohama (JP); Hitoshi Takada, Yokohama (JP); Tatsuo Nanjo, Kawasaki (JP); Hideki Ogura, Yokohama (JP); Hironori Murakami, Tokyo (JP); Hideo Fukazawa, Chigasaki (JP); Eiichi Adachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/189,958

(22) Filed: Feb. 25, 2014

(65) Prior Publication Data

US 2014/0176647 A1 Jun. 26, 2014

Related U.S. Application Data

(62) Division of application No. 13/768,651, filed on Feb. 15, 2013, now Pat. No. 8,770,731.

(30) Foreign Application Priority Data

Feb. 23, 2012 (JP) ..... 2012-037660

(51) Int. Cl.
*B41J 2/175* (2006.01)

(52) U.S. Cl.
CPC ..... *B41J 2/17596* (2013.01); *B41J 2/17509* (2013.01); *B41J 2/17556* (2013.01)

(58) Field of Classification Search
USPC ..... 347/84, 85, 86
See application file for complete search history.

(56) References Cited

U.S. PATENT DOCUMENTS

| | | | | |
|---|---|---|---|---|
| 5,583,549 | A | 12/1996 | Ujita et al. | 347/86 |
| 5,589,862 | A | 12/1996 | Ujita et al. | 347/87 |
| 5,721,576 | A * | 2/1998 | Barinaga | 347/85 |
| 6,283,586 | B1 | 9/2001 | Childers | 347/85 |
| 6,386,693 | B1 | 5/2002 | Michele et al. | 347/86 |
| 6,773,099 | B2 | 8/2004 | Inoue et al. | 347/86 |
| 6,830,324 | B2 | 12/2004 | Ogura et al. | 347/86 |
| 6,854,836 | B2 | 2/2005 | Ishinaga et al. | 347/85 |
| 6,935,739 | B2 | 8/2005 | Inoue et al. | 347/104 |
| 6,969,161 | B2 | 11/2005 | Kuwabara et al. | 347/85 |
| 7,077,514 | B2 | 7/2006 | Inoue et al. | 347/86 |
| 7,128,407 | B2 | 10/2006 | Inoue et al. | 347/85 |

(Continued)

FOREIGN PATENT DOCUMENTS

| | | |
|---|---|---|
| JP | 2006-015694 | 1/2006 |
| JP | 2007-130812 | 5/2007 |

*Primary Examiner* — Anh T. N. Vo
(74) *Attorney, Agent, or Firm* — Fitzpatrick, Cella, Harper & Scinto

(57) ABSTRACT

A liquid container and an apparatus in which the liquid container is mountable are provided, the liquid container and the apparatus enabling the presence or absence of remaining liquid to be checked without the need for a power source and even after the liquid container is removed. The pressure in a communication path is maintained while ink in a containing section is not supplied to the exterior. Thus, the displacement state of a detection valve which is displaced depending on the pressure in the communication path can be maintained even after removal of an ink tank.

8 Claims, 20 Drawing Sheets

(56) References Cited

U.S. PATENT DOCUMENTS

| | | | | |
|---|---|---|---|---|
| 7,404,628 | B2 | 7/2008 | Naka et al. | 347/86 |
| 7,784,927 | B2 | 8/2010 | Inoue et al. | 347/86 |
| 8,770,731 | B2 * | 7/2014 | Miyashita et al. | 347/86 |
| 2007/0109368 | A1 | 5/2007 | Kimura | 347/86 |
| 2012/0300003 | A1 | 11/2012 | Takada et al. | 347/86 |
| 2013/0222491 | A1 | 8/2013 | Nanjo et al. | 347/86 |

* cited by examiner

LIQUID CONTAINER AND APPARATUS IN WHICH LIQUID CONTAINER IS MOUNTABLE

This application is a divisional of U.S. patent application Ser. No. 13/768,651, filed Feb. 15, 2013 (currently pending), which is incorporated by reference herein in its entirety, as if fully set forth herein, and claims the benefit of priority under 35 U.S.C. §119, based on Japanese Priority Application No. 2012-037660, filed Feb. 23, 2012, which is incorporated by reference herein in its entirety, as if fully set forth herein.

BACKGROUND OF THE INVENTION

1. Field of the Invention

The present invention relates to a liquid container which can contain various liquids and an apparatus in which the liquid container is mountable. In particular, the present invention relates to a liquid container which is preferably used as an ink tank containing pigment ink, and an apparatus in which the liquid container is mountable and which is preferably used as a printing apparatus for printing images using the pigment ink fed from the ink tank.

2. Description of the Related Art

For example, an ink tank as a liquid container containing ink is mounted in an ink jet printing apparatus or the like to supply ink to a print head provided in the printing apparatus. As examples of such an ink tank, Japanese Patent Laid-Open Nos. 2007-130812 and 2006-15694 describe ink tanks including a detection mechanism which detects when no ink remains in the ink tank.

The ink tank described in Japanese Patent Laid-Open No. 2007-130812 includes a flexible containing bag which contains ink and which is collapsed to pressurize the ink in the containing bag to supply the ink to the exterior though a supply port. A diaphragm is provided in an ink supply path which is in communication with the supply port. When the printing apparatus is supplied with ink through the ink supply path, the pressure in the ink supply path deforms and swells the diaphragm. On the other hand, when no ink remains in the containing bag, no ink is supplied through the ink supply path. Thus, the pressure in the ink supply path decreases to recover the diaphragm to its original shape. Such deformation of the diaphragm is utilized to detect the presence or absence of ink remaining in the containing bag.

The ink tank described in Japanese Patent Laid-Open No. 2006-15694 includes a flexible containing bag which contains ink and which is collapsed to pressurize the ink in the containing bag to supply the ink to the exterior though a supply port. The inside of the containing bag is in communication with one end of a communication pipe in which a gel-like follower is provided. The other end of the communication pipe is in communication with the atmosphere through a differential-pressure check valve. As the ink in the containing bag is supplied to the printing apparatus, the differential-pressure check valve is opened and closed so as to keep the difference in pressure between the inside of the containing bag and the outside air within a predetermined range. Thus, the position of the gel-like follower in the communication pipe is kept within a given range. When no ink remains in the containing bag, the differential-pressure check valve remains open, and the gel-like follower in the communication path moves out of the given range. Such movement of the gel-like follower is utilized to detect the presence or absence of remaining ink. A communication pipe formed of a transparent member allows the position of the follower, which corresponds to the remaining amount of ink, to be externally checked.

The ink tank described in Japanese Patent Laid-Open No. 2007-130812 allows the presence or absence of remaining ink to be detected utilizing a rise in ink pressure occurring when ink is pressurized and supplied. Consequently, this ink tank requires continued pressurization of the ink containing bag. If the pressurization is stopped, the diaphragm recovers to its original shape. Thus, to allow the presence or absence of remaining ink to be detected, a source of compressed air or the like for pressurization of the containing bag needs to be powered on to continue supplying compressed air. Furthermore, when the source is reactivated, the presence or absence of remaining ink cannot be detected until the containing bag is sufficiently pressurized.

The ink tank described in Japanese Patent Laid-Open No. 2006-15694 includes a complicated mechanism for detecting the presence or absence of remaining ink. This may lead to problems depending on the accuracy of components of the differential-pressure check valve. For example, if the inside of the communication pipe between the gel-like follower and the differential-pressure check valve is kept at a pressure higher than the atmospheric pressure by at least an acceptable value, when the pressurization of the ink containing bag is stopped, the gel-like follower moves a long distance, possibly causing erroneous detection of the "absence" of remaining ink. Furthermore, if the inside of the communication pipe between the gel-like follower and the differential-pressure check valve is kept at a negative pressure, when the ink tank with no ink remaining therein is removed, the outside air may flow into the containing bag through the ink supply port to move the gel-like follower. In this case, the "presence" of remaining ink is erroneously detected.

SUMMARY OF THE INVENTION

The present invention provides a liquid container and an apparatus in which the liquid container is mountable, the liquid container and the apparatus enabling the presence or absence of remaining liquid to be checked without the need for a power source and even after the liquid container is removed.

In the first aspect of the present invention, there is provided a liquid container comprising: a containing section at least partly formed of a flexible member and containing a liquid; a supply section configured to supply the liquid in the containing section to an exterior through a supply path which is in communication with inside of the containing section; a displacement section configured to be displaced depending on a pressure in a communication path which is in communication with the inside of the containing section; and a valve section configured to maintain the pressure in the communication path while the liquid in the containing section is not supplied to the exterior.

In the second aspect of the present invention, there is provided an apparatus in which the liquid container according the first aspect of the present invention is mountable, the apparatus comprising a connection section configured to be connectable to the supply section to allow the liquid in the containing section to be introduced.

In the third aspect of the present invention, there is provided an apparatus in which a liquid container is mountable, the liquid container comprising a containing section at least partly formed of a flexible member and containing a liquid, a supply section configured to supply the liquid in the containing section to an exterior through a supply path which is in communication with inside of the containing section, a displacement section configured to be displaced depending on a pressure in a communication path which is in communication with the inside of the containing section, and a valve section configured to maintain the pressure in the communication path while the liquid in the containing section is not supplied to the exterior, the apparatus comprising: a connection section configured to be connectable an introduction path through which the liquid is introduced to the supply section; and a section configured to reduce a pressure in the supply path relative to a pressure in the containing section.

The present invention maintains the pressure in the communication path while the liquid in the containing section is not supplied to the exterior. Thus, the displacement state of the displacement section which is displaced depending on the pressure in the communication path can be maintained even after removal of the liquid container. As a result, depending on the displacement state of the displacement section, the presence or absence of the liquid remaining in the containing section can be checked even after the liquid container is removed. Furthermore, the amount of the liquid remaining in the containing section can be checked.

Further features of the present invention will become apparent from the following description of exemplary embodiments (with reference to the attached drawings).

DESCRIPTION OF THE EMBODIMENTS

Embodiments of the present invention will be described based on the drawings. All liquid containers in the following embodiments are examples of application of the present invention as an ink tank for use in an inkjet printing apparatus.

First Embodiment

FIG. 1 to FIG. 5 are diagrams illustrating a first embodiment of the present invention. The present embodiment will be described for each of a plurality of items.

(Ink Supply System)

Figure 1:
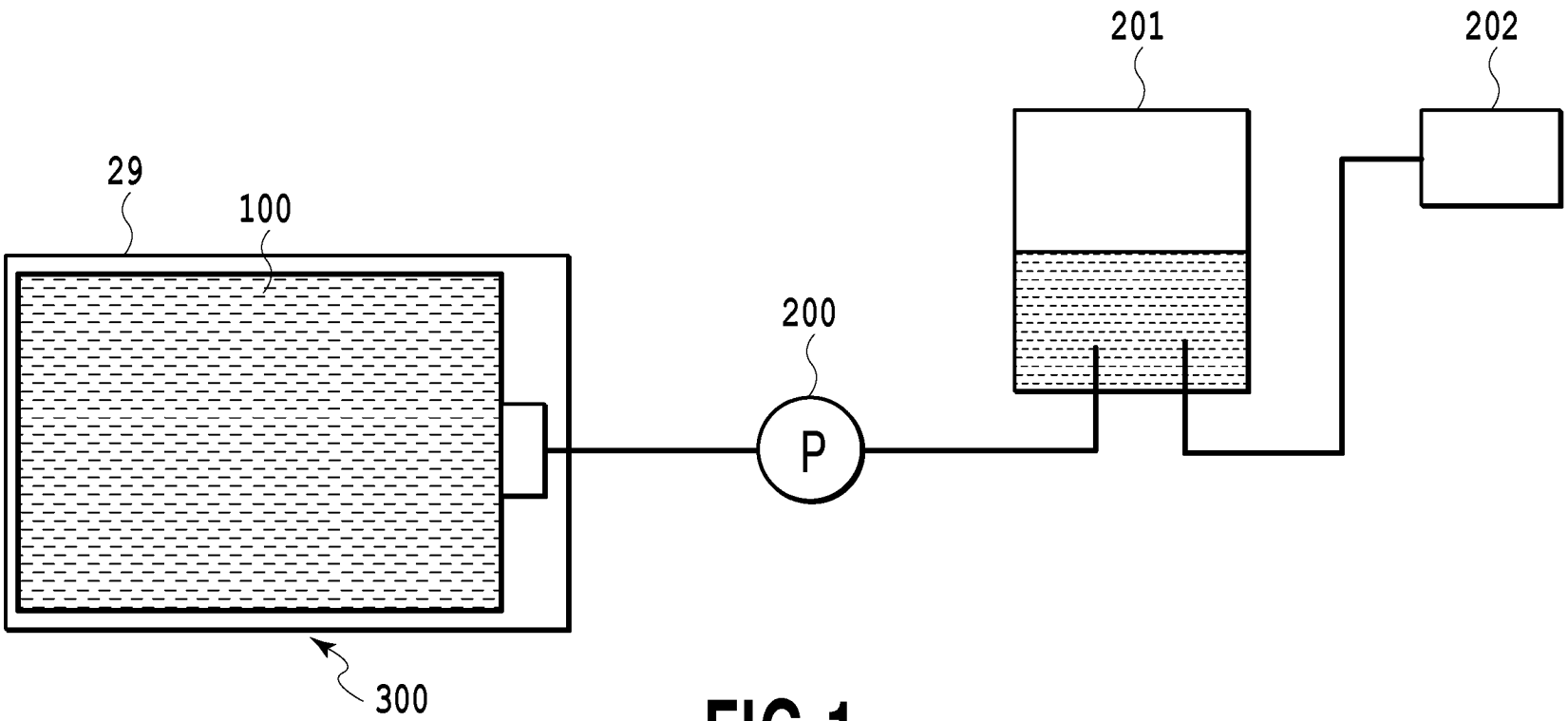
FIG. 1 is a schematic diagram of an ink supply system which is connectable to an ink tank serving as a liquid container according to a first embodiment of the present invention.

FIG. 1 is a diagram illustrating an ink supply system in an ink jet printing apparatus in which an ink tank 300 according to the present embodiment is mountable. The ink tank 300 includes an ink bag 29 which contains ink and which is removably mounted in an ink tank mounting section in the printing apparatus. The ink in a containing section (containing chamber) 100 of the ink bag 29 is sucked by a suction pump 200 and carried to a sub-tank 201 in the printing apparatus through an introduction path. The ink is then supplied to a print head 202.

The print head 202 uses ejection energy generating elements such as electrothermal transducing elements (heaters) or piezo elements to eject ink from nozzles. If electrothermal transducing elements are used, the elements generate heat to bubble the ink so that the resultant bubbling energy can be utilized to eject the ink through ejection ports at the tips of the nozzles. The printing apparatus is based on a printing scheme such as a serial scan scheme or a full line scheme, and prints an image on a print medium by applying ink ejected from the print head 202 to the print medium while moving the print head 202 and the print medium relative to each other. Any printing apparatus may be used as long as the printing apparatus can print an image by applying ink fed from the ink tank 300 to the print medium. The present invention is not limited to printing apparatuses based on an ink jet scheme (ink jet printing apparatuses).

(Configuration of the Ink Tank)

Figure 2:
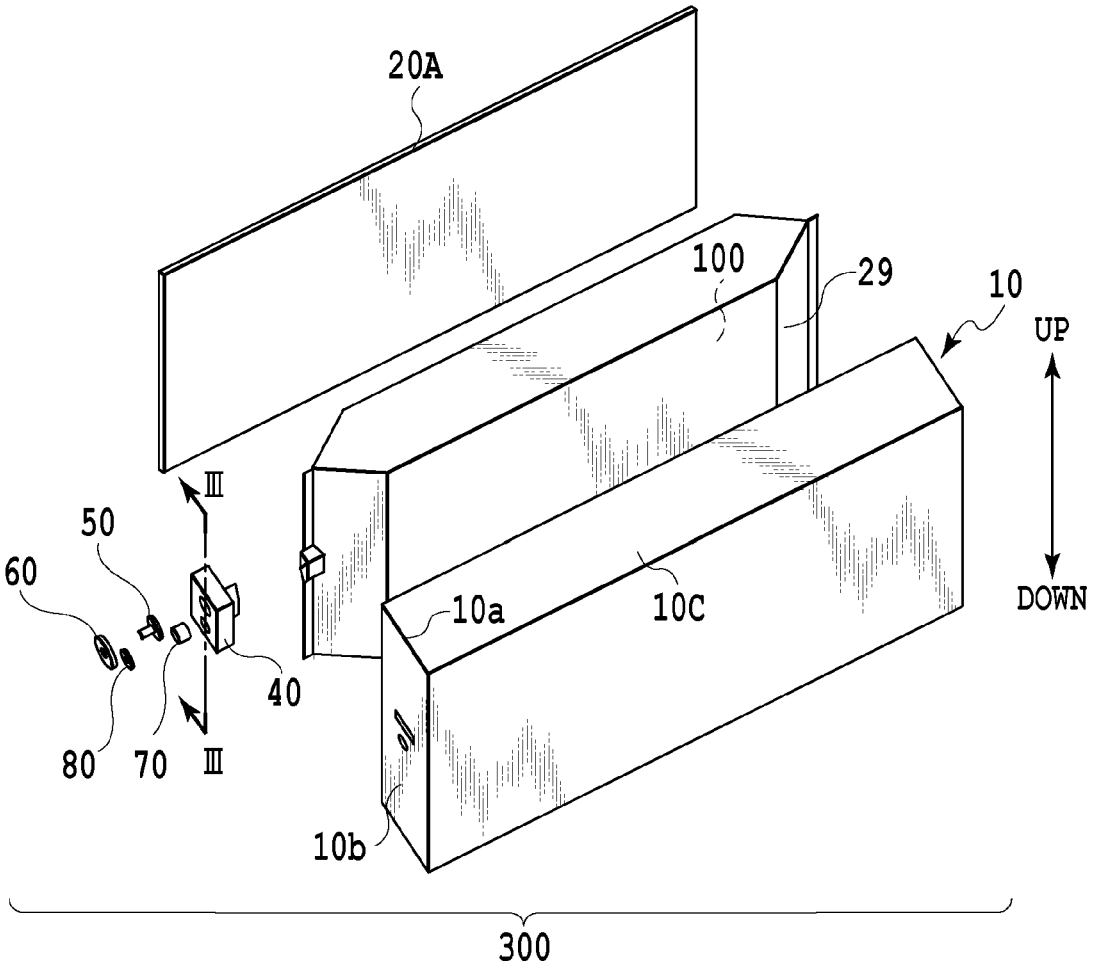
FIG. 2 is an exploded perspective view of the ink tank in FIG. 1.
Figure 3:
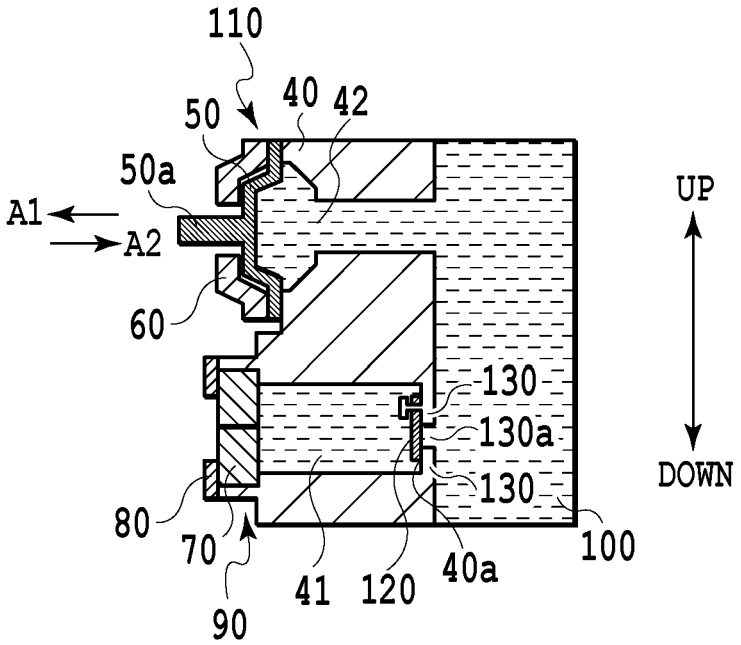
FIG. 3 is a cross-sectional view of the ink tank taken along line III-III in FIG. 2.

FIG. 2 is an exploded perspective view of the ink tank 300. FIG. 3 is a cross-sectional view of the ink tank 300 taken along line in FIG. 2. The ink tank 300 mainly includes a case 10, a cover 20A, and the flexible ink bag 29 which contains ink. A channel forming member 40 is attached to one end of the ink bag 29. The channel forming member 40 includes a supply section 90 which supplies ink to the exterior and a detection section 110 (displacement section) which detects the presence or absence of remaining ink.

The supply section 90 includes a supply path 41 formed in the channel forming member 40 in communication with the inside of the containing section 100 and a rubber plug 70 and a rubber plug presser 80 both attached to the supply path 41. The supply path 41 is connected to the ink supply system on the printing apparatus main body side. In the present example, as a connection section which is connectable to the supply path 41, the printing apparatus main body side includes a supply needle 160 described below. The supply needle 160 is passed through the rubber plug 70 to connect the supply path 41 to the ink supply system in FIG. 1. While the ink tank 300 is connected or unconnected to the ink supply system, the supply section 90 is sealed by the rubber plug 70. Furthermore, the seal configuration for the supply section 90 is not limited to the configuration using the rubber plug 70. For example, the bias force of a spring may be used to press a valve disc against a ring-like rubber member to close off the opening of the supply path 41.

As described below, the detection section 110 includes a detection valve (diaphragm) 50 attached to an opening of a communication path 42 formed in the channel forming member 40 in communication with the containing section 100, and a valve presser member 60 attached to the opening to fix the detection valve 50 to the channel forming member 40.

The ink bag 29 is formed of a deformable, flexible material. The flexible material desirably has a layer structure containing a pliable material in order to allow ink to be appropriately used up; a turn-up portion of the ink bag 29 is easily collapsible. For example, the ink bag 29 may be formed of polyethylene, which is a pliable material. The ink bag 29 may further include nylon, which allows impact resistance to be enhanced, a hard PET layer preventing the surface of the ink bag 29 from being cracked, and an aluminum layer suppressing evaporation of moisture in the ink.

(Detection Mechanism)

The detection section 110 and a check valve (valve section) 120 described below form a detection mechanism for detecting the presence or absence of remaining ink.

The detection valve 50 is fixed by the valve presser member 60 so as to close off the opening of the communication path 42. The detection valve 50 is deformed depending on the pressure inside the detection section 110, which is in communication with the inside of the communication path. The detection valve 50 includes a projecting portion 50*a* which is displaced in axial directions shown by arrows A1 and A2 in conjunction with deformation of the detection valve 50. The communication path 42 is in communication with the inside of the containing section 100. Thus, the pressure inside the detection section 110 is the same as the pressure in the containing section 100. As described below, the detection valve 50 is displaced in the direction of arrow A2 toward the inside of the communication path 42 when the pressure of the containing section 100 is equal to or lower than a predetermined value. The detection valve 50 is displaced in the direction of arrow A1 as shown in FIG. 3 when the pressure of the containing section 100 is higher than the predetermined value.

In the supply section 90, a partitioning wall 130 forming an outlet port 130*a* is provided between the supply path 41 and the ink containing section 100. A valve contact surface 40*a* is formed on a surface of the partitioning wall 130 which is closer to the supply path 41. A check valve 120 is attached to the valve contact surface 40*a* to enable the outlet port 130*a* to be opened and closed. The check valve 120 is formed of a thin-plate-like elastic material and includes a proximal end fixed by caulking so as to cover the outlet port 130*a*.

(Detection Operation)

FIG. 4A, FIG. 4B, FIG. 4C, and FIG. 4D are diagrams illustrating a detection operation performed by the detection mechanism.

Figure 4A:
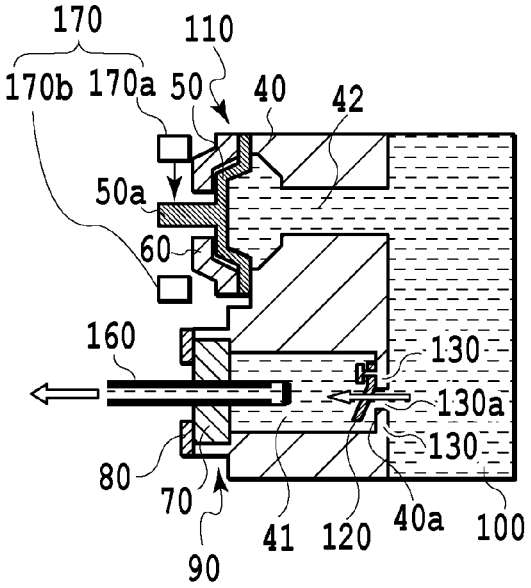
FIG. 4A, FIG. 4B, FIG. 4C, and FIG. 4D are cross-sectional views respectively illustrating different operating states of the ink tank in FIG. 3.

For ink supply, as shown in FIG. 4A, the supply needle 160 in the main body of the printing apparatus (apparatus main body side) is connected to the supply section 90 so that the suction force of the suction pump 200 in FIG. 1 allows the ink in the containing section 100 of the ink bag 29 to be supplied to the ink supply system through the supply needle 160. That is, the ink in the containing section is supplied by reducing the pressure in the supply section relative to the pressure in the containing section. For ink supply, the check valve 120 is deformed as shown in FIG. 4A to open the outlet port 130*a*, allowing the ink in the containing section 100 to flow into the supply path 41. When a sufficient amount of ink remains in the containing section 100, the internal pressures of the containing section 100 and the detection section 110 are prevented from varying because the ink bag 29 is deformed in association with a decrease in the amount of remaining ink to reduce the volume of the containing section 100. Thus, the detection valve 50 is in the state of its original form in which the detection valve 50 swells outward as shown in FIG. 4A. At this time, the projecting portion 50*a* of the detection valve 50 projects outward from the detection section 110 as shown in FIG. 4A.

Figure 4B:
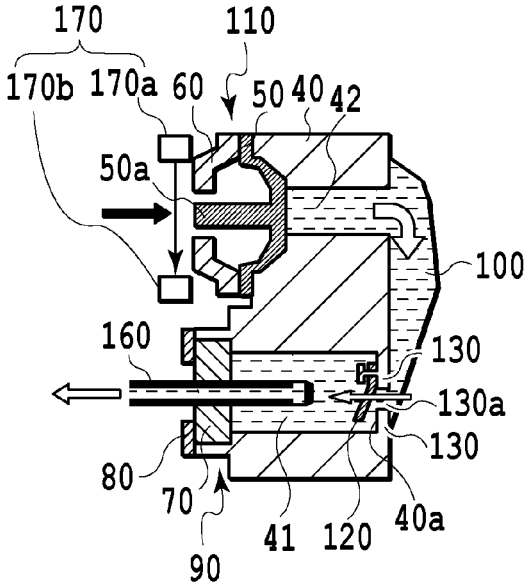

When the ink in the containing section 100 is used up and no ink remains in the containing section 100, the ink inside the detection section 110, which is in communication with the communication path 42, is exhausted. The channel forming member 40, in which the detection section 110 is configured, is rigid. Thus, when the negative pressure inside the detection section 110 rapidly increases above the force of the detection valve 50 acting to maintain the original form, the detection valve 50 is inwardly deformed as shown in FIG. 4B. At this time, the projecting portion 50*a* of the detection valve 50 moves inward of the detection section 110 as shown in FIG. 4B.

Such movement of the projecting portion 50*a* can be detected by an optical sensor 170 provided on the apparatus main body side. The optical sensor 170 includes a light emitting section 170*a* and a light receiving section 170*b*. While the detection valve 50 maintains its original form as shown in FIG. 4A, the projecting portion 50*a* is interposed between the light emitting section 170*a* and the light receiving section 170*b* to block light from the light emitting section 170*a* to the light receiving section 170*b*. Thus, the optical sensor 170 detects the "presence" of remaining ink. On the other hand, when the detection valve 50 is deformed as shown in FIG. 4B, the projecting portion 50*a* moves away from the position between the light emitting section 170*a* and the light receiving section 170*b*. Then, the light receiving section 170*b* receives light from the light emitting section 170*a*, and the optical sensor 170 detects the "absence" of remaining ink. In the present example, during such ink supply, the inside of the detection section 110 is in communication with the inside of the supply section 90. Hence, if the ink bag 29 is collapsed to block the flow of ink in the containing section 100, thus precluding the ink supply despite the presence of a slight amount of remaining ink, then the ink supply can be continued until the ink inside the detection section 110 is exhausted.

Figure 4C:
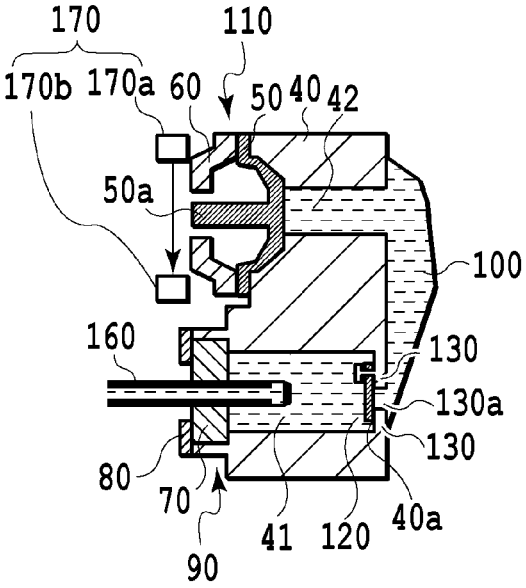

When the ink supply based on the suction force of the suction pump 200 in the ink supply system stops, the check valve 120 recovers to its original state by elastic restoring force to close off the outlet port 130*a* as shown in FIG. 4C. The detection valve 50 acts to recover to its original form shown in FIG. 4A, by its own elastic restoring force. However, the check valve 120 closes the outlet port 130*a* to maintain the pressure in the containing section 100 and the pressure in the communication path 42. Consequently, the detection valve 50 is kept deformed inward of the detection section 110 as shown in FIG. 4C.

Figure 4D:
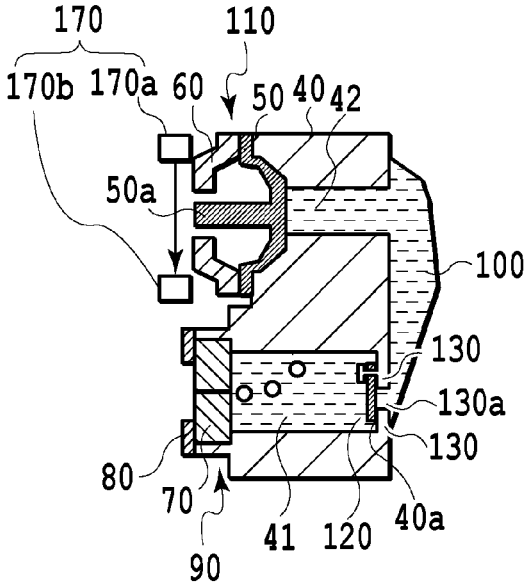

Furthermore, after the ink supply is thus stopped, when the supply needle 160 is pulled out from the supply section 90 for replacement of the ink tank 300, a hole portion of the rubber plug 70 resulting from penetration by the supply needle 160 is occluded by the restoring force of the rubber plug 70. At this time, if air enters the supply section 90 through the hole portion of the rubber plug 70 as shown in FIG. 4D, the air is inhibited from flowing into the containing section 100. Thus, the pressure in the containing section 100 and the pressure in the communication path 42 are maintained to keep the detection valve 50 deformed inward of the detection section 110 as shown in FIG. 4D. When a window is formed in the case 10 of the ink tank 300 to allow the shape of the detection valve 50 to be externally checked, the presence or absence of remaining ink can be visually checked even after the ink tank 300 is removed from the apparatus main body.

Figure 5:
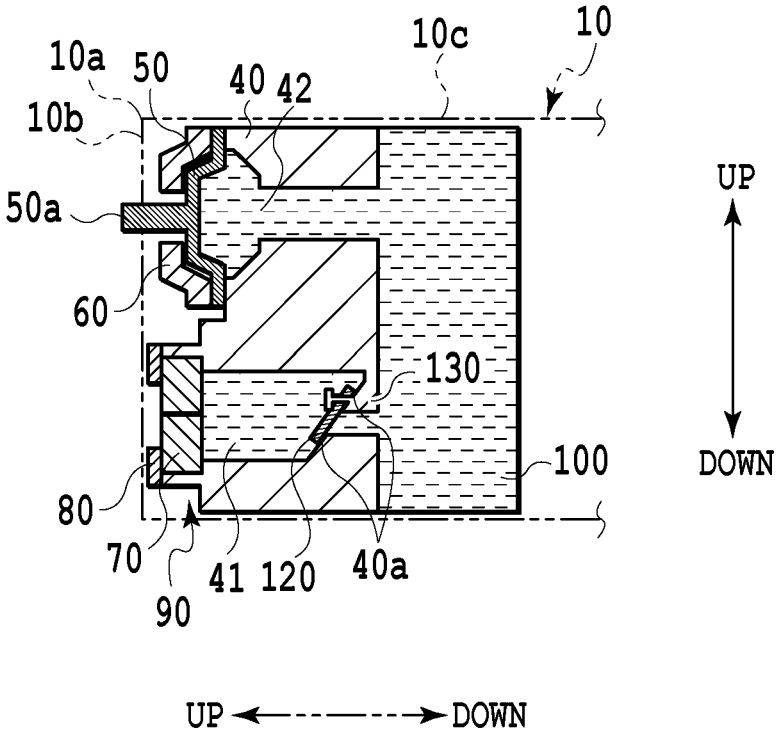
FIG. 5 is a cross-sectional view of an essential part of the ink tank in FIG. 3 illustrating a variation of a valve contact surface of the ink tank.

FIG. 5 is a diagram illustrating a variation of the valve contact surface 40*a*. In the above-described example, the valve contact surface 40*a* is formed to extend vertically when the ink tank 300 is mounted in the apparatus main body. In the example in FIG. 5, the valve contact surface 40*a* is formed to incline to a vertical surface when the ink tank 300 is in the mounted state.

Inclining the valve contact surface 40*a* in this manner positions the check valve 120 above the valve contact surface 40*a* in the direction of gravitational force in the mounted state of the ink tank 300. Thus, when the outlet port 130*a* is closed as shown in FIG. 4C and FIG. 4D, the check valve 120 comes into more reliable contact with the valve contact surface 40*a*. Moreover, the check valve 120 is pressed against the valve contact surface 40*a* by gravitational force, thus allowing the outlet port 130*a* to be more appropriately closed. Hence, the flow of ink from inside the supply section 90 into the containing section 100 can be more reliably stopped. As a result, a rise in the pressure inside the containing section 100 and in the pressure inside the detection section 110 can be more significantly delayed to extend the time for which the detection valve 50 is kept deformed inward of the detection section 110. Furthermore, inclining the valve contact surface 40*a* as in the present example leads to the appropriate positional relation between the check valve 120 and the valve contact surface 40*a* in a plurality of installed orientations of the ink tank 300. The valve contact surface 40*a* in the present example is inclined so as to face a ridge line 10*a* of the case 10 as shown in FIG. 5. This results in the appropriate positional relation between the check valve 120 and the valve contact surface 40*a* when the case 10 is oriented with its surface 10*b* up and when the case 10 is oriented with its surface 10*c* up.

Second Embodiment

FIG. 6A, FIG. 6B, FIG. 6C, and FIG. 6D are diagrams illustrating a second embodiment of the present invention. According to the present embodiment, the projecting portion 50*a* of the detection valve 50 includes a protruding engagement portion 50*b* formed thereon. Furthermore, the valve presser member 60 includes an engagement portion 60*a* formed thereon and corresponding to the engagement portion 50*b*. The remaining part of configuration of the present embodiment is similar to the corresponding part of configuration of the first embodiment.

Figure 6A:
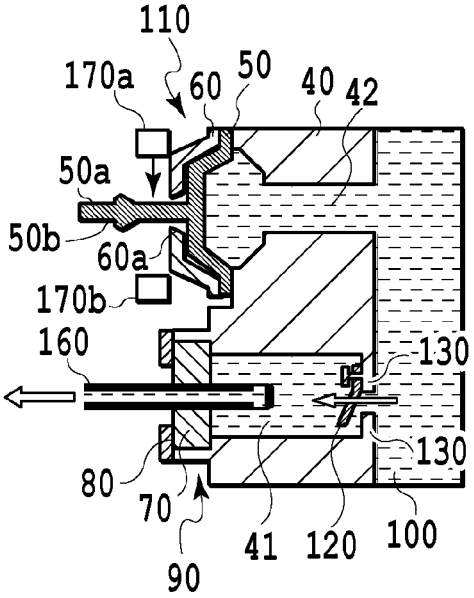
FIG. 6A, FIG. 6B, FIG. 6C, and FIG. 6D are cross-sectional views respectively illustrating different operating states of an ink tank serving as a liquid container according to a second embodiment of the present invention.

When a sufficient amount of ink remains in the containing section 100, the volume of the containing section 100 decreases consistently with the remaining amount of ink as is the case with the first embodiment, as shown in FIG. 6A. This prevents a variation in the pressure inside the containing section 100 and in the pressure inside the detection section 110, with the detection valve 50 maintaining its original form.

Figure 6B:
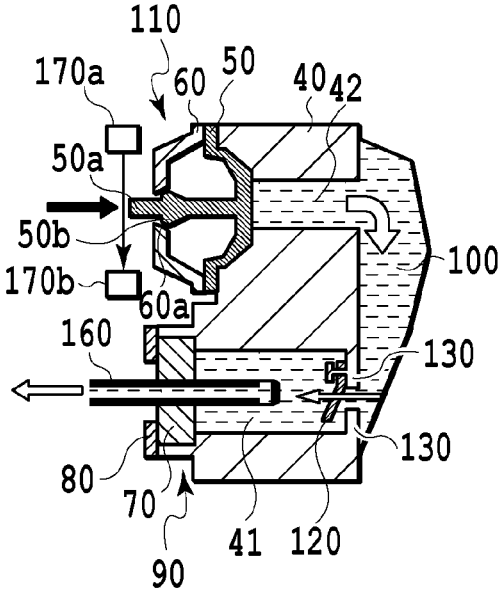

When the ink in the containing section 100 is used up and no ink remains in the containing section 100, the ink inside the detection section 110, which is in communication with the communication path 42, is also exhausted. The channel forming member 40, in which the detection section 110 is configured, is rigid. Thus, when the negative pressure inside the detection section 110 rapidly increases above the force of the detection valve 50 acting to maintain the original form, the detection valve 50 is inwardly deformed as shown in FIG. 6B. Then, as in the case of the first embodiment, the optical sensor 170 on the apparatus main body side detects the deformation of the detection valve 50 and thus the "absence" of remaining ink. Furthermore, at this time, the engagement portion 50*b* of the detection valve 50 comes into engagement with the engagement portion 60*a* of the valve presser member 60.

Figure 6C:
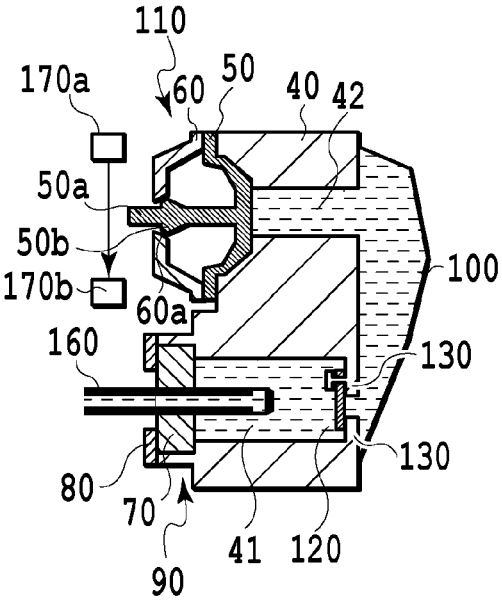

The supply of ink to the ink supply system is stopped. Then, as is the case with the first embodiment, the check valve 120 recovers, by elastic restoring force, to its original state to close off the outlet port 130*a*, with the detection valve 50 kept deformed inward of the detection section 100, as shown in FIG. 6C. Furthermore, if air enters the supply section 90 when the ink tank 300 is removed from the apparatus main body, the check valve 120 inhibits the air from flowing into the containing section 100 as is the case with the first embodiment. Therefore, the pressure in the containing section 100 and the pressure in the communication path 42 are maintained to keep the detection valve 50 deformed inward of the detection section 110 as shown in FIG. 6C.

Figure 6D:
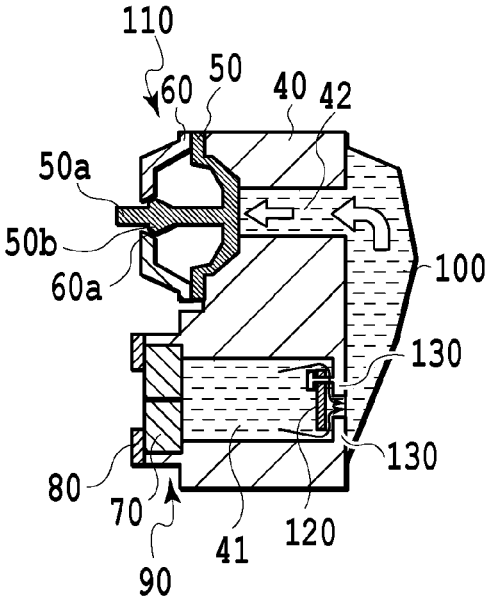
Figure 7:
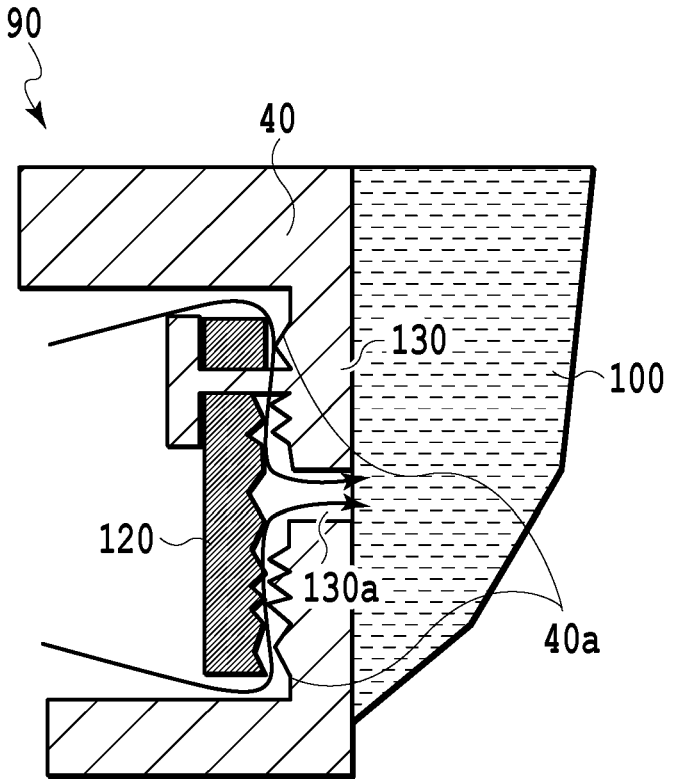
FIG. 7 is an enlarged cross-sectional view of a portion of the ink tank in FIG. 6A which includes a check valve.

A variation in surface accuracy between the check valve 120 and the valve contact surface 40*a* may prevent a reliable contact between the check valve 120 and the valve contact surface 40*a*. Thus, as shown in FIG. 7, air may slowly enter the containing section 100 though possible gaps between the check valve 120 and the valve contact surface 40*a* to increase the pressure in the containing section 100. Even if the pressure in the containing section 100 thus increases, the engagement between the engagement portion 50*b* of the detection valve 50 and the engagement portion 60*a* of the valve presser member 60 is maintained as shown in FIG. 6D. As a result, the detection valve 50 can be kept deformed inward of the detection section 110.

Third Embodiment

FIG. 8 to FIG. 14 are diagrams illustrating a third embodiment of the present invention. The present embodiment will be described for each of a plurality of items.

(Ink Supply System)

Figure 8:
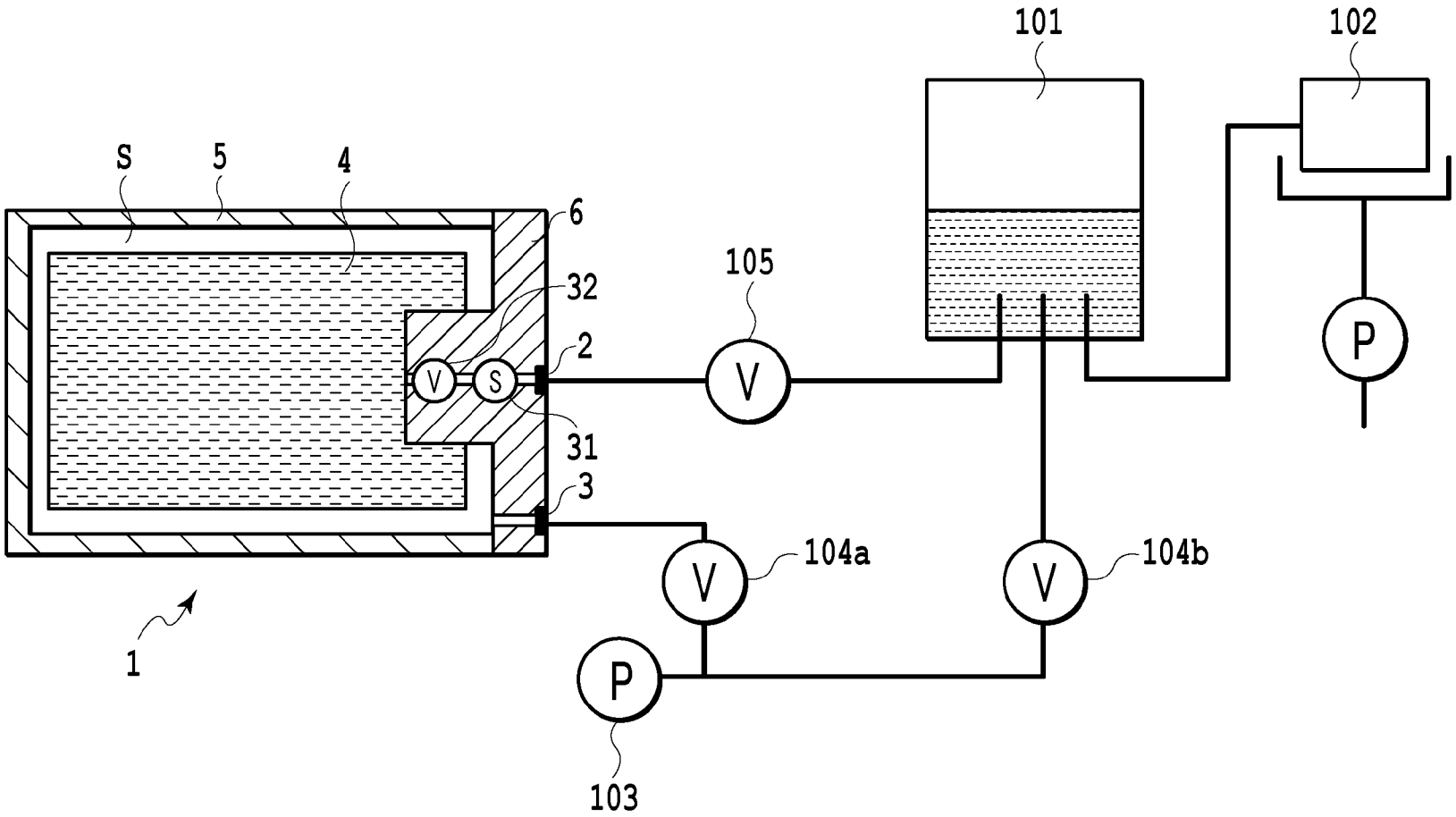
FIG. 8 is a schematic diagram of an ink supply system which is connectable to an ink tank serving as a liquid container according to a third embodiment of the present invention.

FIG. 8 is a schematic diagram of an ink supply system in an ink jet printing apparatus in which an ink tank (liquid container) 1 according to the present embodiment is mountable.

The ink tank 1 includes an ink bag 4 which contains ink, a boat-shaped channel forming member 6 fixed to an opening of the ink bag 4, and a tank case 5. An ink supply port 2 and a pressurization port 3 (pressurized air injection port), formed in the channel forming member 6, are connected to the ink supply system on the main body of the printing apparatus (apparatus main body). A space (pressurization chamber) S into which pressure can be introduced is formed between the ink bag and the tank case 5. The pressurization port 3 is in communication with the space S and introduces compressed air from a pressurization pump 103 on the apparatus main body side into the space S. A pressure valve 104*a* is opened and closed to introduce compressed air from the apparatus main body side into the space S and to release the pressure in the space S when the apparatus main body is powered off. A detection section 31 is provided between the ink bag 4 and the ink supply port 2. Moreover, a check valve 32 is provided in the channel between the detection section 31 and the ink bag 4.

The ink in the ink bag 4 pressurized by the compressed air in the space S is fed to a sub-tank 101 on the apparatus main body side via the ink supply port 2 and further to a print head 102 through a channel. That is, the ink in the ink bag 4 is fed by setting the inside of the supply port 2 to a low pressure relative to the inside of the ink bag 4. A check valve 105 is arranged in the channel between the ink tank 1 and the sub-tank 101 to prevent a reverse flow of ink. The check valve 105 can be opened and closed by a control device on the apparatus main body side. In the ink supply system in the present example, the detection section 31 is disposed between the check valve 32 on the ink tank 1 and the check valve 105 on the apparatus main body side.

(Configuration of the Ink Tank)

Figure 9:
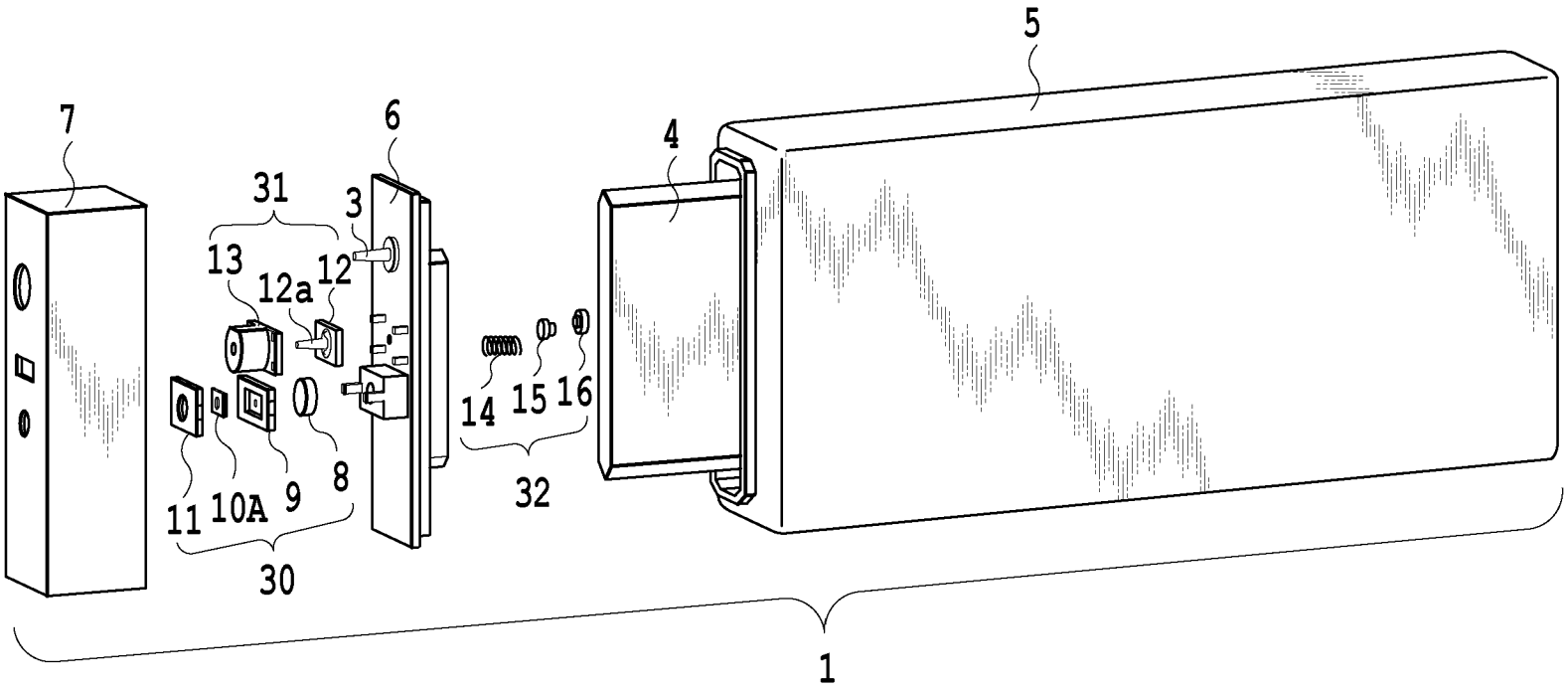
FIG. 9 is a an exploded perspective view of the ink tank in FIG. 8.
Figure 10B:
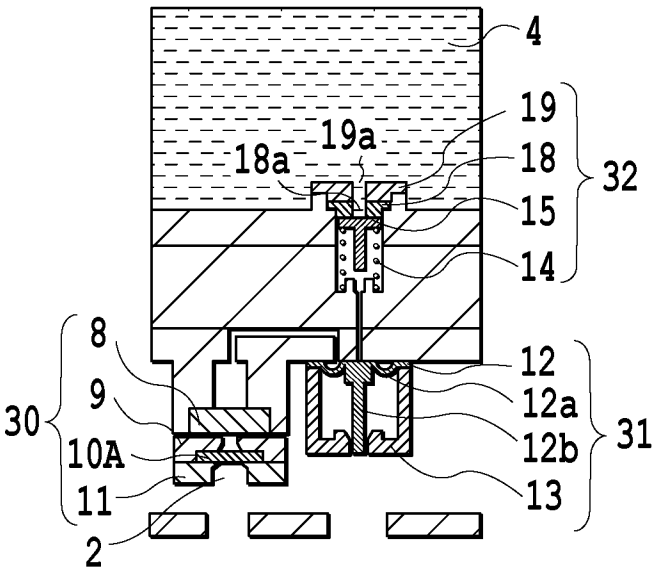
FIG. 10A and FIG. 10B are cross-sectional views of an essential part of the ink tank in FIG. 9 illustrating an example of a different configuration of a check valve in the ink tank.
Figure 10A:
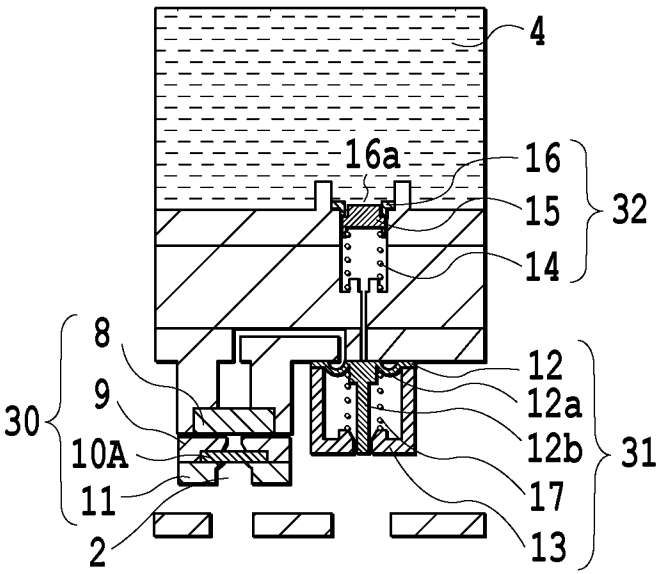

FIG. 9 is an exploded perspective view of the ink tank 1. FIG. 10A and FIG. 10B are cross-sectional views of an essential part of the ink tank 1 illustrating an example of a different configuration of the detection section 31 and the check valve 32.

The ink bag 4 is formed of a deformable, flexible material, and feeds the ink inside the ink bag 4 to the exterior when pressurized by compressed air from the apparatus main body. The flexible material desirably has a layer structure containing a pliable material allowing the ink bag 4 to be easily collapsed in order to allow the ink to be appropriately used up. An example of such a material is a sheet structure containing polyethylene, which is a pliable material, sandwiched between a nylon film which improves impact resistance and a polypropylene film serving as a welded layer. Alternatively, a film with a layer structure partly formed of an aluminum sheet or a multilayer film structure including a vapor-deposited layer of silica or the like may be used in order to suppress evaporation.

The channel forming member 6 includes an ink supply channel formed therein to feed the ink in the ink bag 4 to the apparatus main body and a pressurized gas supply channel also formed therein and through which pressurized gas is fed from the apparatus main body into the space S. Furthermore, the ink supply channel includes an ink supply port portion 30 connected to the apparatus main body, a detection section 31, and a check valve 32.

The ink supply port portion 30 includes a rubber plug 8, a rubber plug presser 9, an absorber 10A, and an absorber presser 11. The ink supply port 2 is connected to a connection section 20 on the apparatus main body (see FIG. 11) such as a supply needle. A connecting portion of the ink supply port 2 and the connection section 20 is sealed by the elasticity of rubber or the like so as to prevent leakage of ink. Furthermore, the absorber 10A is provided to absorb ink seeping through the connecting portion to prevent the ink from dripping out through the ink supply port 2 when the ink tank 1 is mounted or removed.

The detection section 31 is disposed in the channel between the ink bag 4 and the ink supply port 2. A diaphragm valve 12 serving as a detection valve is formed of an elastic material such as rubber or a pliable resin film. The diaphragm valve 12 is displaced when the pressure of ink flowing from inside the ink bag 4 into an ink supply channel becomes equal to or higher than a predetermined value. The diaphragm valve 12 in the present example includes a semicircular deformation portion 12*a* (see FIG. 12C) formed thereon so as to be deformed even when the pressure in the ink supply channel slightly changes. The diaphragm valve 12 is pressed at its outer peripheral portion by a valve presser 13 and fixed to the channel forming member 6. Thus, a seal is maintained between the outer peripheral portion of the diaphragm valve 12 and the channel forming member 6. The diaphragm valve 12 may be fixed by welding or any other method. The diaphragm valve 12 in FIG. 10B recovers to its original shape utilizing the elasticity of the rubber of the diaphragm valve 12. However, the diaphragm valve 12 may be configured so as to recover to its original shape by bias force of a spring 17 as shown in FIG. 10A.

The check valve 32 in FIG. 10A is arranged in the channel between the ink bag 4 and the detection section 31. The check valve 32 includes a spring member 14, a valve disc 15, and a valve disc presser 16. The check valve 32 is configured to bias the valve disc 15, an elastic body, toward the valve disc presser 16. When ink flows from the ink bag 4 toward the ink supply port 2, the check valve 32 opens the outlet port 16*a* of the valve disc presser 16 to permit a flow of ink in the corresponding direction. When the ink acts to flow in the opposite direction, the valve disc 15 closes the outlet port 16*a* of the valve disc presser 16 by the bias force of the spring member 14. The flow of the ink is thus inhibited. The check valve 32 in FIG. 10B is configured such that the valve disc 15, formed of resin, is biased by the spring member 14 with respect to a seal rubber (seal member) 18 fixed by a rubber presser 19. A hole 19*a* in the rubber presser 19 and a hole 18*a* in the seal rubber 18 form a series of through-holes which are opened and closed by the valve disc 15. The through-holes are closed by the spring member 14 pressing the valve disc 15 against the seal rubber 18.

An inner layer of the ink bag 4 and the channel forming member 6 are formed of the same material such as polypropylene or polyethylene and thermally welded together. The channel forming member 6 with the ink bag 4 welded thereto is fixed to the tank case 5. In this case, to prevent the pressurized air in the space S from leaking from the junction between the channel forming member 6 and the tank case 5, the junction is closed utilizing supersonic welding or thermal plate welding or an O ring or seal rubber. A tank cover 7 is fixed to protect the ink supply port portion 30, the detection section 31, and the pressurization port 3 on the channel forming member 6.

(Mounted State of the Ink Tank)

Figure 11:
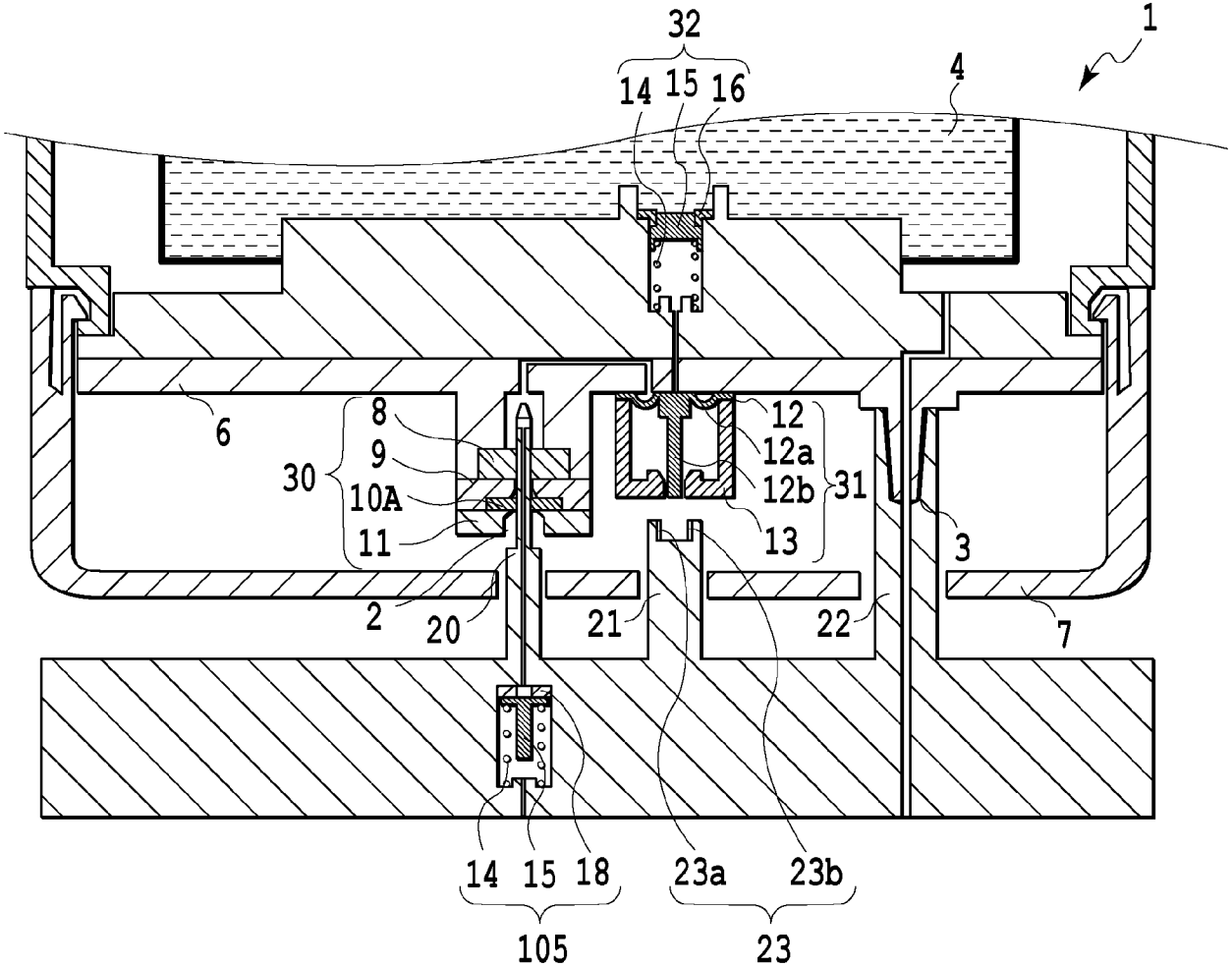
FIG. 11 is a cross-sectional view of a mounted state of the ink tank in FIG. 9.

FIG. 11 is a cross-sectional view showing an essential part of the ink tank 1 mounted in the apparatus main body.

An ink connection section 20, a detection section 21, and a pressurized fluid connection section 22 are arranged in an ink tank mounting portion of the apparatus main body in which the ink tank 1 is mounted. Furthermore, a check valve 105 is disposed in a channel between the connection section 20 and the print head 102 (see FIG. 8). The check valve 105 includes a spring member 14, a valve disc 15, and a seal rubber 18 to prevent a reverse flow of ink from the print head 102. The check valve 105 may have any configuration provided that the check valve 105 enables a reverse flow of ink from the print head 102 to be prevented. While the ink tank 1 is in the mounted state, the ink connection section 20 and pressurized fluid connection section 22 on the apparatus main body side are connected to the ink supply port 2 and pressurization port 3 on the ink tank 1 side, with the connecting portion sealed.

The detection section 21 in the present example uses an optical sensor 23 to detect the amount of ink remaining in the ink tank 1. The sensor 23 includes a light emitting section 23*a* and alight receiving section 23*b* lying opposite each other at the same height. The sensor 23 determines whether or not light from the light emitting section 23*a* is blocked by a cylindrical projecting portion 12*b* of the diaphragm valve 12. The result of the detection is communicated to the apparatus main body side to detect the amount of ink remaining in the ink tank 1. The operation of the diaphragm valve 12 will be described below.

(Detection Operation)

FIG. 12A to FIG. 14 are enlarged views of an essential part of the ink tank 1 illustrating the operation of the diaphragm valve 12 while the ink tank 1 is in the mounted state.

Figure 12A:
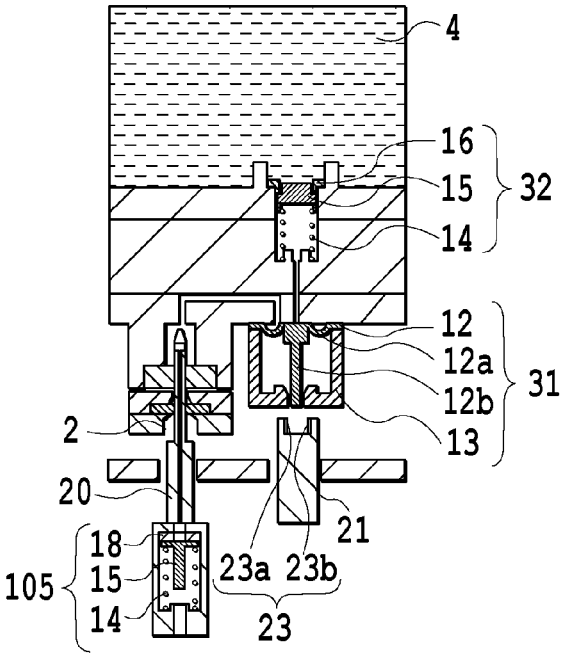
FIG. 12A is a cross-sectional view showing a state of an essential part of the ink tank in FIG. 9 before ink supply.
Figure 12B:
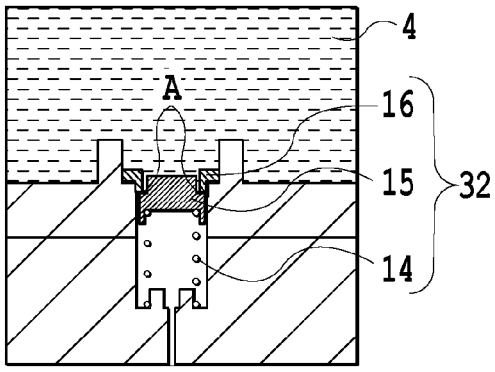
FIG. 12B is an enlarged cross-sectional view of a check valve on an ink tank side in FIG. 12A.

FIG. 12A is a diagram illustrating that after mounting of the ink tank 1, the ink bag 4 has not been pressurized yet. The diaphragm valve 12 in the ink supply port channel includes the semicircular deformation portion 12*a* (see FIG. 12C) formed thereon and which is deformed in response even to a slight change in pressure. Furthermore, the deformation portion 12*a* includes the cylindrical projecting portion 12*b* formed in a central portion thereof which is subjected to the most significant deformation. FIG. 12B is an enlarged cross-sectional view of the check valve 32 portion in the state shown in FIG. 12A. Since the ink bag 4 has not been pressurized, the valve disc 15 is pressed against the valve disc presser 16 by the bias force of the spring member 14. A portion A in which the valve disc 15 and the valve disc presser 16 contact each other is sealed, with the check valve 32 closed. This prevents the flow of ink in the ink supply channel and avoids application of an internal pressure to the inside of the channel. Thus, the diaphragm valve 12 is prevented from being deformed.

Figure 12C:
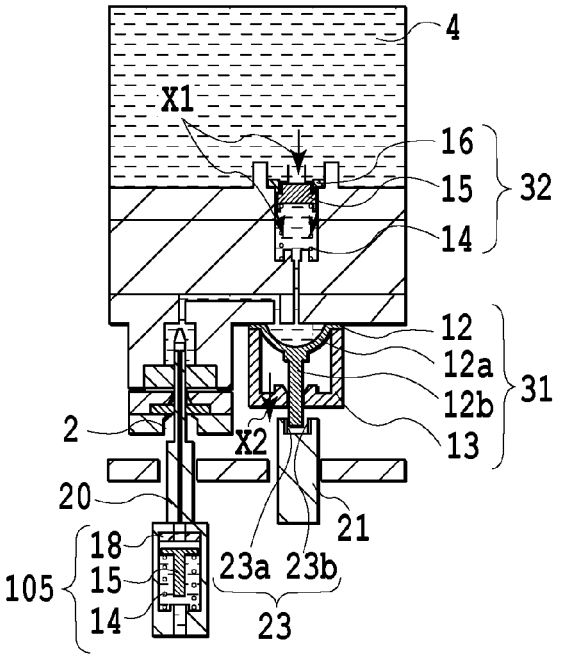
FIG. 12C is a cross-sectional view showing a state of the essential part of the ink tank in FIG. 9 during ink supply.
Figure 12D:
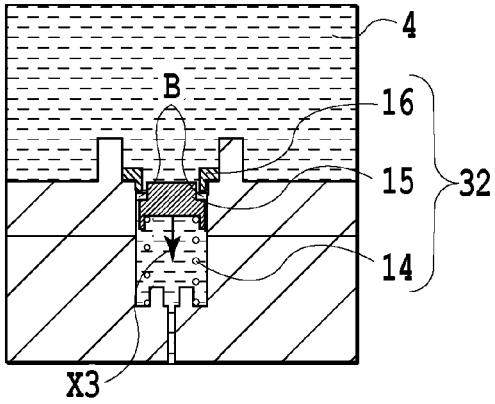
FIG. 12D is an enlarged cross-sectional view of the check valve on the ink tank side in FIG. 12C.

FIG. 12C shows that compressed air is fed from the apparatus main body into the space S (see FIG. 8) through the pressurization port 3 to pressurize the ink bag 4. When the ink bag 4 in the tank case 5 is pressurized to make a pressure applied to the valve disc 15 of the check valve 32 equal to or greater than the bias force of the spring member 14, the check valve 32 is opened to cause the ink in the ink bag 4 to flow in the direction of arrow X1 into the ink supply channel. FIG. 12D is an enlarged cross-sectional view of the check valve 32 in the state shown in FIG. 12C. The valve disc 15 closed so as to seal the portion A in FIG. 12B is moved in the direction of arrow X3 when the pressure in the ink bag 4 exceeds the bias force of the spring member 14. Thus, the seal on the portion A is released. The ink in the ink bag 4 is guided to the supply port 2 through a gap created in a portion B in FIG. 12D and then opens the check valve 105 on the apparatus main body side as shown in FIG. 12C. As a result, the ink in the ink bag 4 is fed from the supply port 2 to the ink supply system through the check valve 105.

As shown in FIG. 12C, the pressure of the ink flowing through the ink supply channel acts to expand the diaphragm valve 12 in the direction of arrow X2. The projecting portion 12*b* of the diaphragm valve 12 thus moves toward the sensor 23 of the detection section 21 on the apparatus main body side. Then, the projecting portion 12*b* blocks the optical path between the light emitting section 23*a* and the light receiving section 23*b*. Consequently, the apparatus main body detects the "presence" of remaining ink.

Figure 13B:
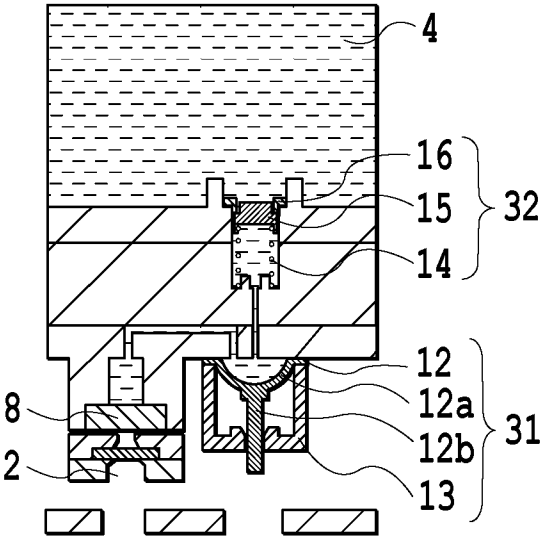
FIG. 13B is a cross-sectional view showing a state of the essential part of the ink tank in FIG. 9 during removal.
Figure 13A:
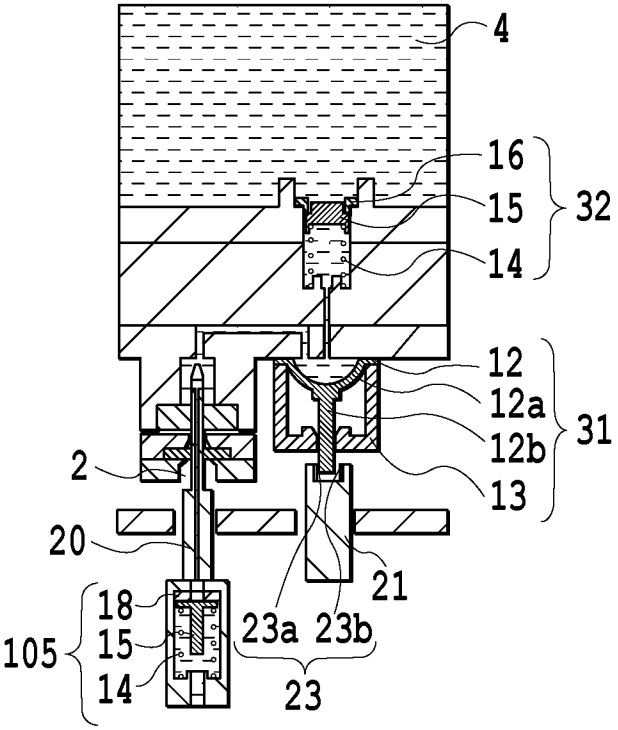
FIG. 13A is a cross-sectional view showing a state of an essential part of the ink tank in FIG. 9 when an apparatus main body with the ink tank mounted therein is powered off.

FIG. 13A shows a state of the ink tank when the apparatus main body is powered off after a printing operation is performed by the printing apparatus. If the apparatus main body is powered off, a valve 104*a* on the apparatus main body side in FIG. 8 is switched so as to allow the pressurization port 3 to communicate with the atmosphere. Thus, the pressure in the space S in the ink tank 1 is released to the atmosphere. As a result, the pressurization of the ink bag 4 is canceled, and the spring member 14 presses the valve disc 15 against the valve presser 16 to close the check valve 32. Furthermore, the check valve 105 on the apparatus main body side is closed as shown in FIG. 13A to prevent a reverse flow of ink. Therefore, an area of the ink supply channel spanning from the check valve 105 to the check valve 32 on the ink tank 1 is sealed, with the pressure in this area maintained. Since the pressure is thus maintained, the diaphragm valve 12 swollen as shown in FIG. 12C is kept expanded even after the apparatus main body is powered off. Hence, the projecting portion 12*b* of the diaphragm valve 12 is held at a position where the projecting portion 12*b* blocks the optical path in the sensor 23 on the apparatus main body side.

FIG. 13B shows the ink tank 1 removed from the apparatus main body. Before the ink tank 1 is removed from the apparatus main body, the supply of compressed air from the apparatus main body side is interrupted to enable the removal of the ink tank 1. First, when the pressurization of the ink bag 4 by compressed air from the apparatus main body side is cancelled, the check valve 105 on the apparatus main body side and the check valve 32 on the ink tank side are closed to seal the channel portion between the check valves 105 and 32 as described above. Thereafter, when the ink supply connection section 20 is removed from the ink supply port 2, the ink supply port 2 is closed by the rubber plug 8. Hence, the swollen diaphragm valve 12 is kept expanded even after the ink tank 1 is removed from the apparatus main body. When a window is formed in the cover 7 to allow the state of the diaphragm valve 12 to be externally checked, the "presence" of ink remaining in the ink tank 1 can be visually checked.

Thus, even if the apparatus main body is powered off or the ink tank 1 is removed, the diaphragm valve 12 is kept expanded and deformed. In this state, when the apparatus main body is powered on again or the ink tank 1 is mounted in the apparatus main body again, the projecting portion 12*b* of the diaphragm valve 12 is positioned to block the optical path in the sensor 23. Thus, the apparatus main body can directly detect the "presence" of remaining ink.

Figure 14:
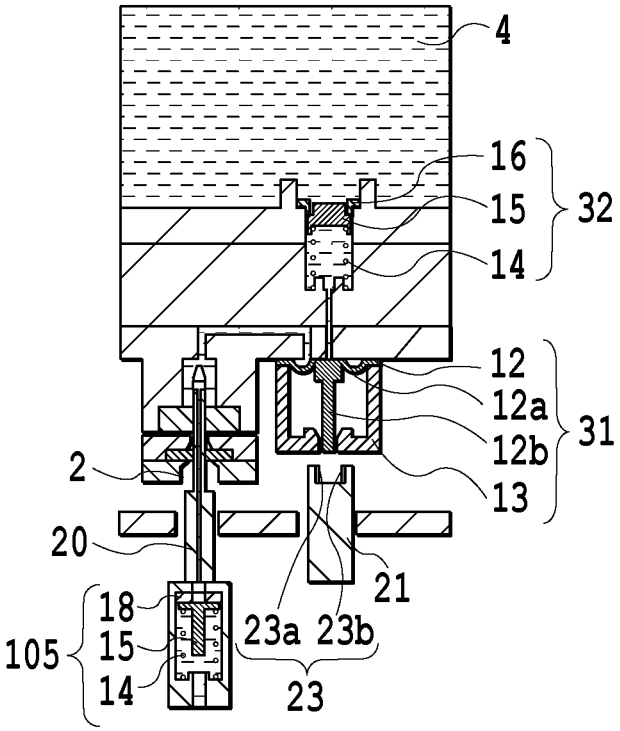
FIG. 14 is a cross-sectional view showing a state of an essential part of the ink tank in FIG. 9 when no ink remains in the ink tank.

FIG. 14 shows a state of the ink tank 1 when the ink in the ink tank 1 is used up, with no ink remaining in the ink tank 1. When the ink in the ink bag 4 is exhausted and the ink bag 4 is completely collapsed by compressed air, the ink in the ink supply channel is prevented from flowing to close the check valve 32. As the apparatus main body side further consumes ink, the ink present in the ink supply channel is fed to the apparatus main body side. The diaphragm valve 12 is accordingly deformed as shown in FIG. 14. The projecting portion 12*b* of the diaphragm valve 12 moves to a position where the projecting portion 12*b* does not block the optical path in the sensor 23. Thus, the apparatus main body can detect the "absence" of remaining ink and notify a user of the result of the detection using an alarm section such as a lamp.

As described above, when the apparatus main body side is powered off before the ink in the ink tank 1 is used up or the ink tank 1 is temporarily removed from and then mounted into the apparatus main body again, the pressurization of the ink bag 4 by compressed air from the apparatus main body is cancelled. However, in such a case, the check valve 32 prevents a reverse flow of ink from the ink supply port 2 to the ink bag 4 to maintain the pressure in the channel from the ink supply port 2 to the check valve 32. Consequently, the diaphragm valve 12 of the detection section 31, positioned in the channel, is kept displaced. Hence, even immediately after the power-on of the apparatus main body side or the mounting of the ink tank 1, the presence or absence of remaining ink can be directly checked.

Fourth Embodiment

Figure 15:
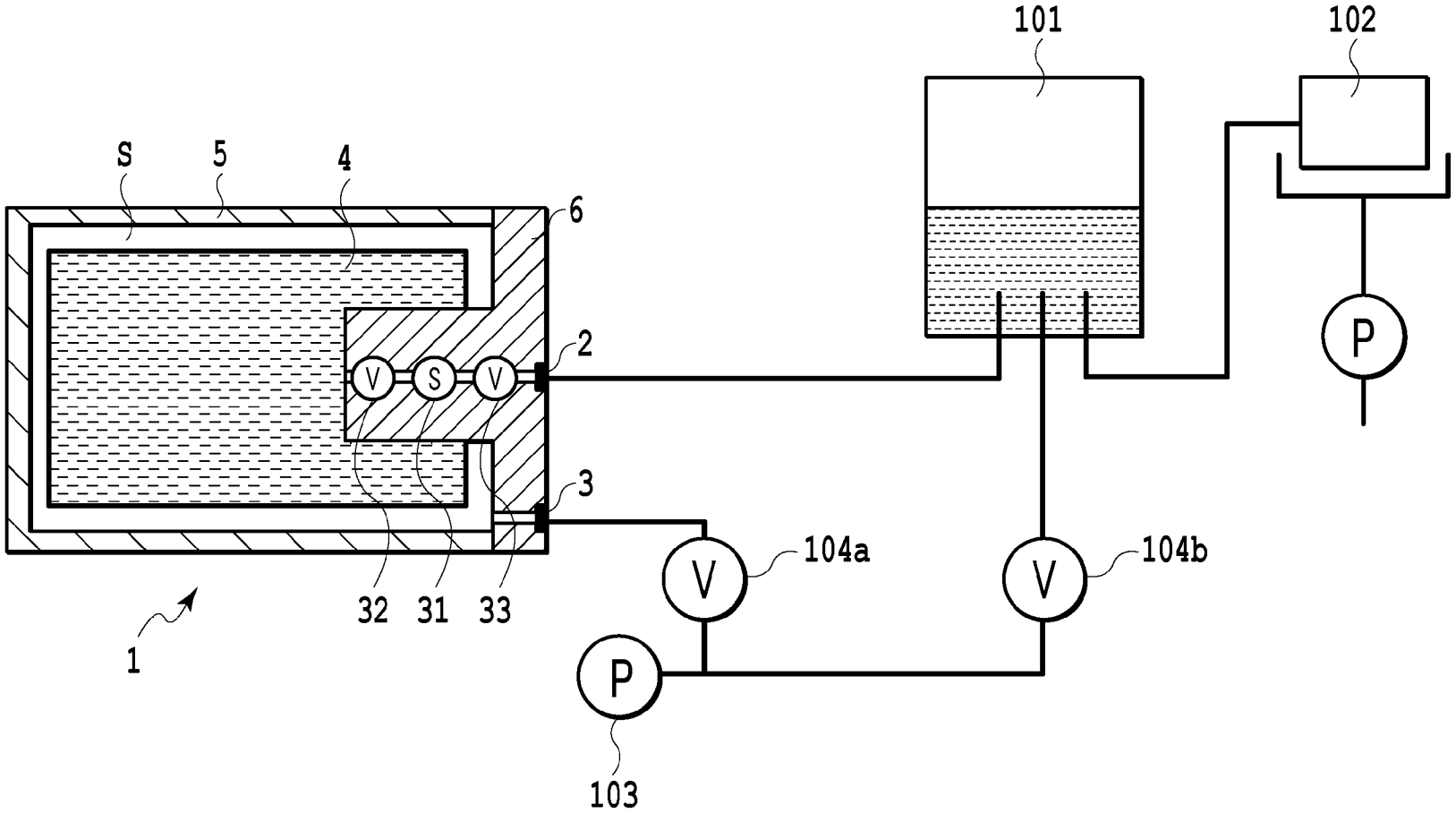
FIG. 15 is a schematic diagram of an ink supply system which is connectable to an ink tank serving as a liquid container according to a fourth embodiment of the present invention.

FIG. 15 schematically shows an ink supply system according to a fourth embodiment of the present invention. The present embodiment is configured such that the check valve 105 provided on the apparatus main body side according to the third embodiment is arranged on the ink tank 1 side as a check valve 33. When the check valve 33 is disposed in the channel between the ink supply port 2 and the detection section 31, advantageous effects similar to the advantageous effects of the third embodiment can be exerted as described below.

(Configuration of the Ink Tank)

Figure 16:
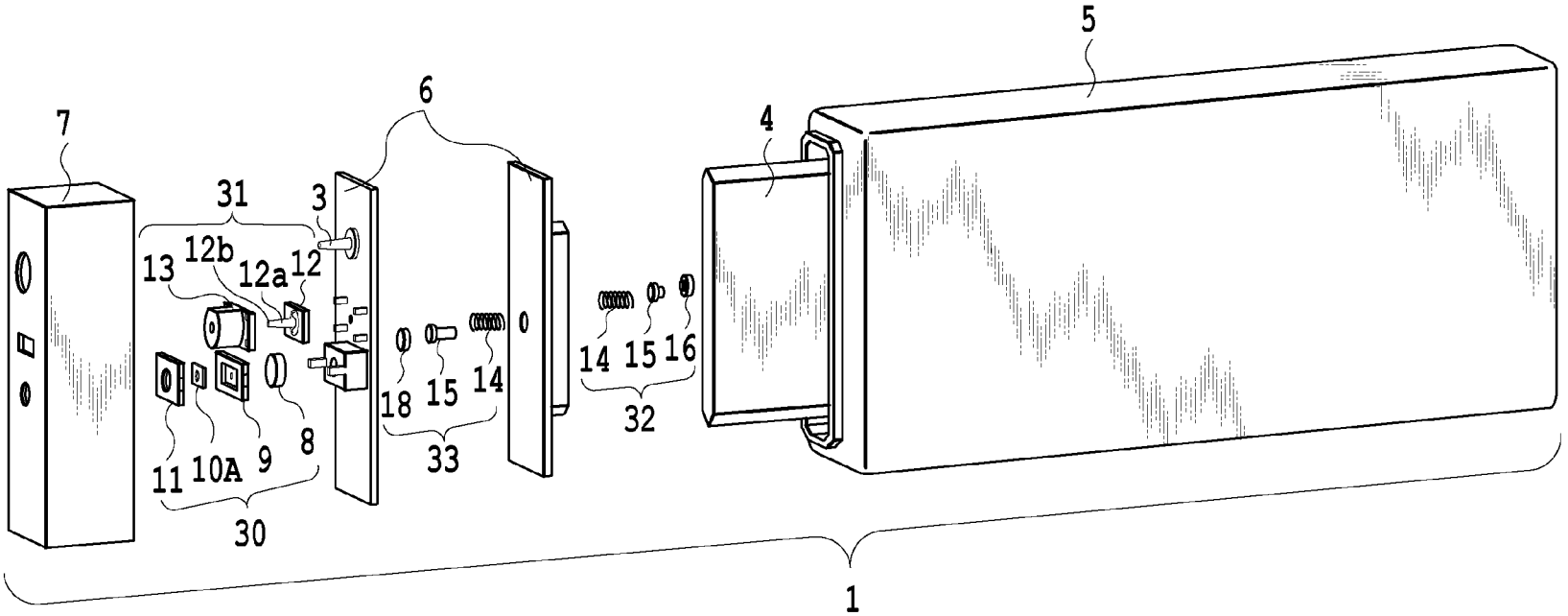
FIG. 16 is a an exploded perspective view of the ink tank in FIG. 15.

FIG. 16 is an exploded perspective view of the ink tank 1 according to the present embodiment. As described above, the present embodiment disposes, instead of the check valve 105 according to the third embodiment, the check valve 33 in the channel between the detection section 31 and the ink supply port 2. The check valve 33 includes the spring member 14, the valve disc 15, and the seal rubber 18. The valve disc 15, formed of resin, is pressed against the seal rubber 18 by the bias force of the spring member 14 to close the outlet port 18*a* (see FIG. 17) of the seal rubber 18. Only during ink supply when the ink in the ink bag 4 flows toward the ink supply port 2, the check valve 33 is open to permit the flow of the ink. On the other hand, when the ink acts to flow in the opposite direction, the check valve 33 is closed to inhibit a reverse flow of the ink. The detection section 31 is disposed between the check valves 33 and 32. Since both check valves 32 and 33 are open only during ink supply when the ink is fed from the ink bag 4 to the ink supply port 2, the stoppage of the ink supply causes the check valves 32 and 33 to be closed to maintain the pressure in the ink channel.

(Mounted State of the Ink Tank)

Figure 17:
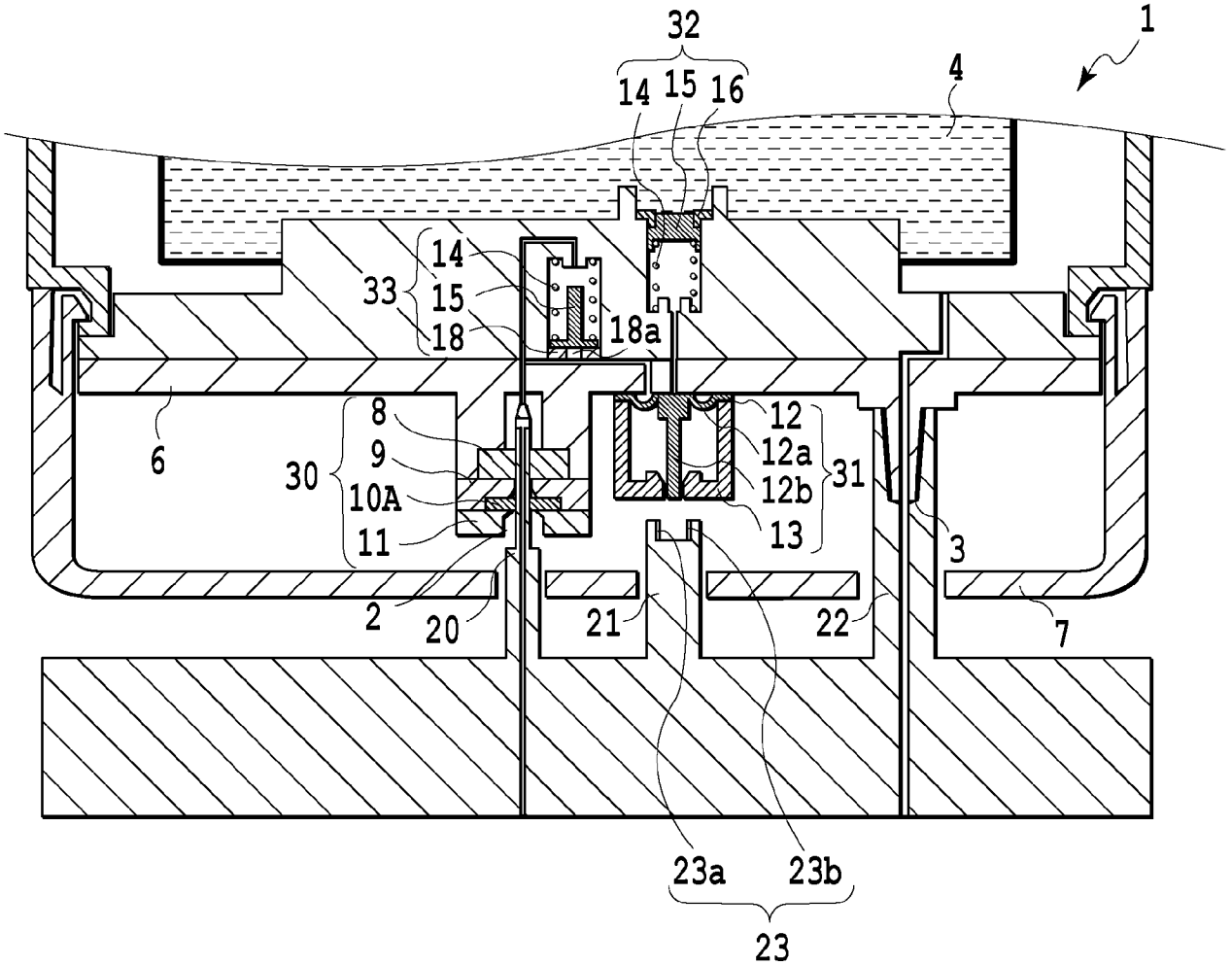
FIG. 17 is a cross-sectional view of a mounted state of the ink tank in FIG. 15.

FIG. 17 is a cross-sectional view of an essential part of the ink tank 1 mounted in the apparatus main body.

The ink connection section 20, the detection section 21, and the pressurized fluid connection section 22 are arranged in the ink tank mounting portion of the apparatus main body in which the ink tank 1 is mounted. While the ink tank 1 is in the mounted state, the ink connection section 20 and pressurized fluid connection section 22 on the apparatus main body side are connected to the ink supply port 2 and pressurization port 3 on the ink tank 1 side, with the connection section sealed. The operation of the diaphragm valve 12 will be described below.

(Detection Operation)

FIG. 18A to FIG. 20 are enlarged views of an essential part of the ink tank 1 in its mounted state, illustrating the operation of the diaphragm valve 12 and the check valve 33.

Figure 18A:
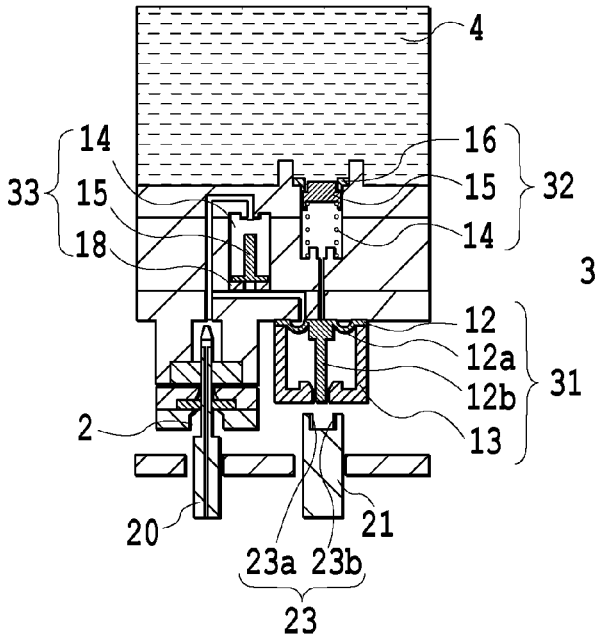
FIG. 18A is a cross-sectional view showing a state of an essential part of the ink tank in FIG. 15 before ink supply.
Figure 18B:
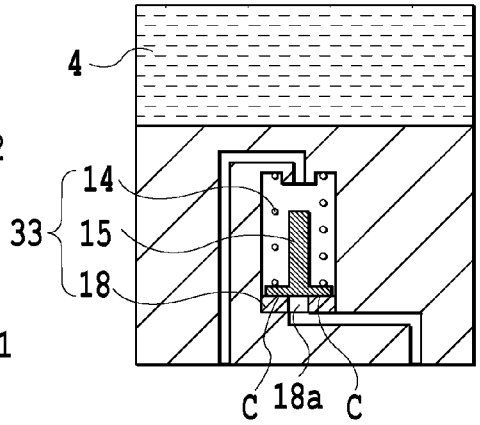
FIG. 18B is an enlarged cross-sectional view of a check valve in FIG. 18A.

FIG. 18A is a diagram illustrating that after mounting of the ink tank 1, the ink bag 4 has not been pressurized yet. FIG. 18B is an enlarged view of the check valve 33 portion in the state shown in FIG. 18A. Since the ink bag 4 is not pressurized, the valve disc 15 of the check valve 32 is pressed against the valve disc presser 16 by the spring member 14, and the portion A (see FIG. 12B) in which the valve disc 15 and the valve disc presser 16 contact each other is sealed, as is the case with the above-described embodiments. Thus, the check valve 32 is closed. Furthermore, the valve disc 15 of the check valve 33 is similarly pressed against the seal rubber 18 by the spring member 14, and a portion C in which the valve disc 15 and the seal rubber 18 contact each other is sealed. Thus, the check valve 33 is also closed. This prevents the flow of ink in the portion of the ink channel positioned between the check valves 33 and 32 and avoids application of pressure to the channel portion. Consequently, the diaphragm valve 12 is prevented from being deformed as shown in FIG. 18A.

Figure 18C:
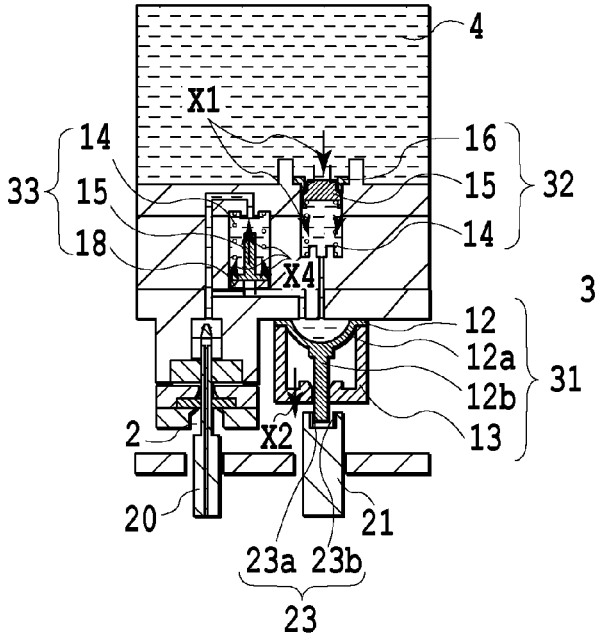
FIG. 18C is a cross-sectional view showing a state of the essential part of the ink tank in FIG. 15 during ink supply.
Figure 18D:
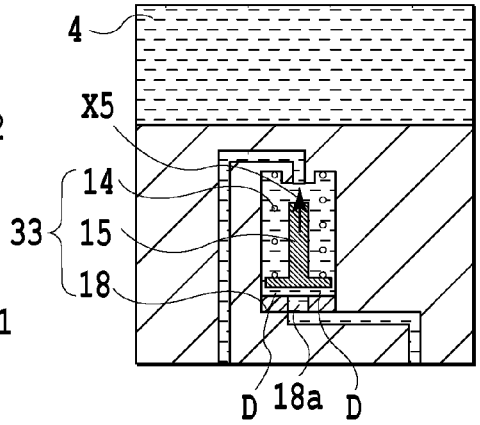
FIG. 18D is an enlarged cross-sectional view of the check valve in FIG. 18C.

FIG. 18C shows a state of the ink tank when compressed air is fed from the apparatus main body into the space S (see FIG. 15) through the pressurization port 3 to pressurize the ink bag 4. When the ink bag 4 in the tank case 5 is pressurized to make the pressure applied to the valve disc 15 of the check valve 32 equal to or greater than the bias force of the spring member 14, the check valve 32 is opened to cause the ink in the ink bag 4 to flow in the direction of arrow X1 into the ink supply channel. The check valve 33 is similarly opened to permit a flow of ink in the direction of arrow X4 when the pressure applied to the valve disc 15 is equal to or greater than the bias force of the spring member 14. FIG. 18D is an enlarged view of the check valve 33 portion in the state shown in FIG. 18C. The valve disc 15 closed so as to seal the portion C in FIG. 18B is moved in the direction of arrow X5 when the pressure in the ink bag 4 exceeds the bias force of the spring member 14. Thus, the seal on the portion C is released. The ink in the ink bag 4 is guided to the supply port 2 through a gap created in a portion D in FIG. 18D.

As shown in FIG. 18C, the pressure of the ink flowing through the ink supply channel acts to expand the diaphragm valve 12 in the direction of arrow X2. The projecting portion 12*b* of the diaphragm valve 12 thus moves toward the sensor 23 of the detection section 21 on the apparatus main body side. Then, the projecting portion 12*b* blocks the optical path between the light emitting section 23*a* and the light receiving section 23*b*. Consequently, the apparatus main body detects the "presence" of remaining ink.

Figure 19B:
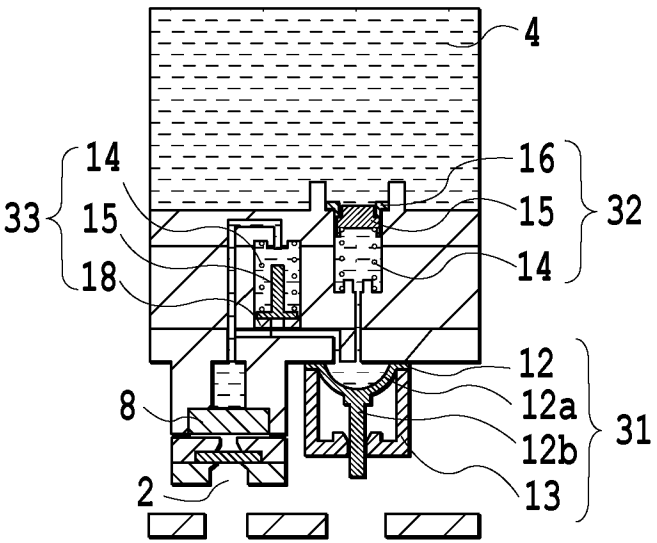
FIG. 19B is a cross-sectional view showing a state of the essential part of the ink tank in FIG. 15 during removal.
Figure 19A:
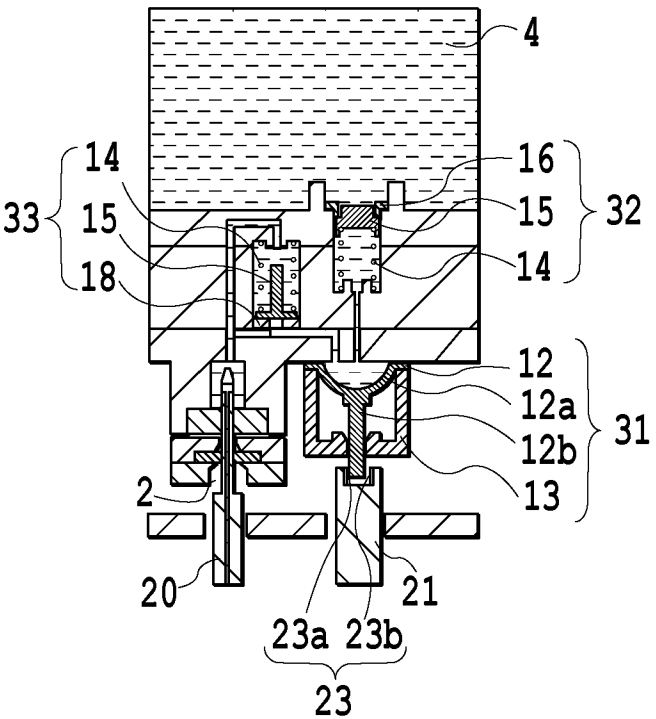
FIG. 19A is a cross-sectional view showing a state of an essential part of the ink tank in FIG. 15 when an apparatus main body with the ink tank mounted therein is powered off.

FIG. 19A shows a state of the ink tank when the apparatus main body is powered off after a printing operation is performed by the printing apparatus. If the apparatus main body is powered off, the valve 104*a* on the apparatus main body side in FIG. 15 is switched so as to allow the pressurization port 3 to communicate with the atmosphere. Thus, the pressure in the space S in the ink tank 1 is released to the atmosphere. As a result, the pressurization of the ink bag 4 is canceled, and the spring member 14 presses the valve disc 15 against the valve presser 16 to close the check valve 32. The check valve 33 is similarly closed by the spring member 14 pressing the valve disc 15 against the seal rubber 18. Therefore, an area of the ink supply channel between the check valves 32 and 33 is sealed, with the pressure in this area maintained. Since the pressure is thus maintained, the diaphragm valve 12 swollen as shown in FIG. 18C is kept expanded even after the apparatus main body is powered off. Hence, the projecting portion 12*b* of the diaphragm valve 12 is held at the position where the projecting portion 12*b* blocks the optical path in the sensor 23 on the apparatus main body side.

FIG. 19B shows the ink tank 1 removed from the apparatus main body. Before the ink tank 1 is removed from the apparatus main body, the supply of compressed air from the apparatus main body side is interrupted to enable the removal of the ink tank 1. First, when the pressurization of the ink bag 4 by compressed air from the apparatus main body side is cancelled, the two check valves 33 and 32 on the ink tank side are closed to seal the channel portion between the check valves 33 and 32 as described above. Thereafter, when the ink supply connection section 20 is removed from the ink supply port 2, the ink supply port 2 is closed by the rubber plug 8. Hence, the swollen diaphragm valve 12 is kept expanded even after the ink tank 1 is removed from the apparatus main body. When a window is formed in the cover 7 to allow the state of the diaphragm valve 12 to be externally checked, the "presence" of ink remaining in the ink tank 1 can be visually checked.

Thus, even if the apparatus main body is powered off or the ink tank 1 is removed, the diaphragm valve 12 is kept expanded and displaced. In this state, when the apparatus main body is powered on again or the ink tank 1 is mounted in the apparatus main body again, the projecting portion 12*b* of the diaphragm valve 12 is positioned to block the optical path in the sensor 23. Thus, the apparatus main body can directly detect the "presence" of remaining ink.

Figure 20:
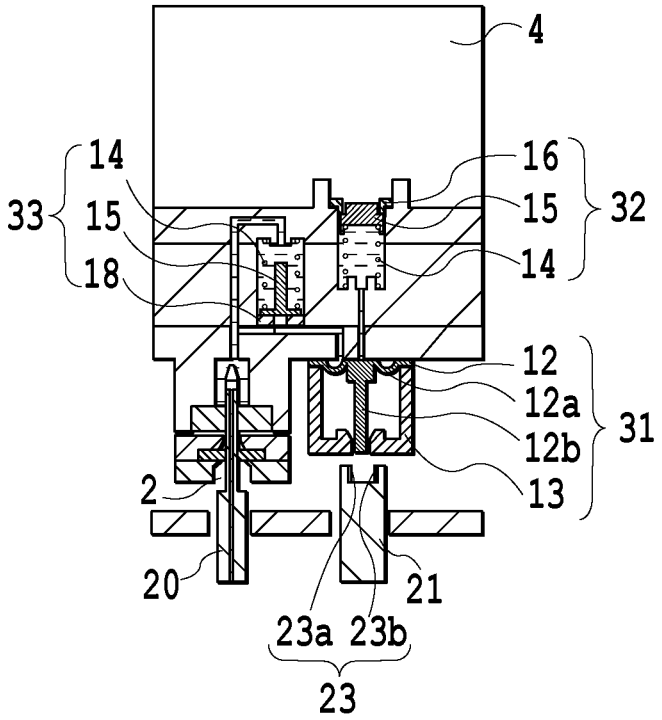
FIG. 20 is a cross-sectional view showing a state of an essential part of the ink tank in FIG. 15 when no ink remains in the ink tank.

FIG. 20 shows a state of the ink tank 1 when the ink in the ink tank 1 is used up, with no ink remaining in the ink tank 1. When the ink in the ink bag 4 is exhausted and the ink bag 4 is completely collapsed by compressed air, the ink in the ink supply channel is prevented from flowing to close the check valves 32 and 33. As the apparatus main body side further consumes ink, the ink present in the ink supply channel is fed to the apparatus main body side. The diaphragm valve 12 is accordingly deformed as shown in FIG. 20. The projecting portion 12*b* of the diaphragm valve 12 moves to the position where the projecting portion 12*b* is prevented from blocking the optical path in the sensor 23. Thus, the apparatus main body can detect the "absence" of remaining ink and notify the user of the result of the detection using the alarm section such as a lamp.

As described above, when the apparatus main body side is powered off before the ink in the ink tank 1 is used up or the ink tank 1 is temporarily removed from and then mounted into the apparatus main body again, the pressurization of the ink bag 4 by compressed air from the apparatus main body is cancelled. However, in such a case, the check valves 32 and 33 prevent a reverse flow of ink from the ink supply port 2 to the ink bag 4 to maintain the pressure in the channel between the check valves 32 and 33. Consequently, the diaphragm valve 12 of the detection section 31, positioned in the channel, is kept displaced. Hence, even immediately after the power-on of the apparatus main body side or the mounting of the ink tank 1, the presence or absence of remaining ink can be directly checked.

Other Embodiments

Furthermore, the above-described embodiments adopt the pressurized supply scheme of supplying the ink in the ink tank to the printing apparatus by pressurizing the ink. However, a suction supply scheme may be adopted in which the printing apparatus side exerts a negative pressure in the ink tank to draw the ink in the ink tank to the printing apparatus side. In this case, ink can be supplied using the pressure difference between the ink supply system on the printing apparatus side and the inside of the ink tank, as is the case with the above-described embodiments. The ink tank can be configured as in the case of the above-described embodiments.

The present invention is widely applicable to various liquid containers containing liquids other than ink and is not limited to ink tanks containing ink. Furthermore, the present invention is applicable to various apparatuses in which the liquid container can be mounted, such as apparatuses using the liquid in the liquid container and apparatuses in which the liquid container is stored. The present invention is not limited to printing apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-037660, filed Feb. 23, 2012, which is hereby incorporated by reference herein in its entirety.

What is claimed is:

1. A liquid container comprising:

a containing section at least partly formed of a flexible member and containing a liquid;

a supply section configured to supply the liquid in the containing section to an exterior;

a displacement section provided at a position which is in communication with the containing section through a communication path, the displacement section being configured to be displaced depending on a pressure in the communication path;

a wall member having an opening; and a projecting section connected with the displacement section, the projecting section being movable in the opening depending on a displacement of the displacement section, wherein the projecting section moves from the opening toward an inside of the containing section depending on the pressure in the communication path.

2. The liquid container according to claim 1, further comprising a supply path communicating between the containing section and the supply section.

3. The liquid container according to claim 1, further comprising a check valve provided between the containing section and the supply section.

4. The liquid container according to claim 3, wherein the liquid in the containing section is supplied to the check valve, the displacement section, and the supply section in that order.

5. The liquid container according to claim 1, wherein the liquid in the containing section is supplied to the displacement section and the supply section in that order.

6. The liquid container according to claim 1, wherein the containing section is substantially closed except for the supply section.

7. A liquid container removably mountable with an apparatus providing a print head, the liquid container comprising:

a containing section at least partly formed of a flexible member and containing a liquid to be applied to the print head;

a supply section configured to supply the liquid in the containing section to the print head;

a displacement section provided at a position which is in communication with the containing section through a communication path, the displacement section being configured to be displaced depending on a pressure in the communication path;

a wall member having an opening; and a projecting section connected with the displacement section, the projecting section being movable in the opening depending on a displacement of the displacement section, wherein the projecting section moves from the opening toward an inside of the containing section depending on the pressure in the communication path.

8. The liquid container according to claim 7, further comprising a check valve provided between the containing section and the supply section.

* * * * *